US011168504B2

(12) United States Patent
Eickhoff et al.

(10) Patent No.: US 11,168,504 B2
(45) Date of Patent: Nov. 9, 2021

(54) DOOR OPERATOR HOLD-OPEN ARMATURE ASSEMBLY

(71) Applicant: Schlage Lock Company LLC, Carmel, IN (US)

(72) Inventors: Brian C. Eickhoff, Danville, IN (US); Aditya Heblikar, Ballari (IN); Palraj Palanisamy, Tiruppur (IN); Brady Plummer, Fishers, IN (US); Dharam Deo Prasad, Ranchi (IN); Ramakrishna Moorthy Andamuthu, Pollachi (IN); Subashchandra G. Rai, Bangalore (IN); Latha Ramesh, Bangalore (IN); Vijayakumar Mani, Bangalore (IN)

(73) Assignee: Schlage Lock Company LLC, Carmel, IN (US)

( * ) Notice: Subject to any disclaimer, the term of this patent is extended or adjusted under 35 U.S.C. 154(b) by 27 days.

(21) Appl. No.: 16/778,115

(22) Filed: Jan. 31, 2020

(65) Prior Publication Data

US 2021/0238904 A1 Aug. 5, 2021

(51) Int. Cl.

| | |
|---|---|
| ***E06B 3/00*** | (2006.01) |
| ***E05F 3/22*** | (2006.01) |
| ***E05F 15/60*** | (2015.01) |

(52) U.S. Cl.

CPC ..... *E05F 3/22* (2013.01); *E05F 15/60* (2015.01); *E05Y 2900/132* (2013.01)

(58) Field of Classification Search

CPC ... E05F 3/104; E05F 3/10; E05F 15/70; E05F 3/00; E05F 3/02; E05F 3/04; E05F 3/102; E05F 15/71; E05F 1/105; E05F 1/1091; E05F 3/227; E05F 15/611; E05F 15/60; E05F 15/79; E06B 3/28; E06B 3/36; E06B 9/52; E06B 2003/7059; Y10T 16/56; Y10T 16/585; Y10T 16/27; Y10T 16/577;

(Continued)

(56) References Cited

U.S. PATENT DOCUMENTS

| | | | |
|---|---|---|---|
| 3,729,770 | A | 5/1973 | Lasier |
| 4,286,412 | A | 9/1981 | Stevens |
| 4,314,722 | A | 2/1982 | Logan, Jr. |

(Continued)

FOREIGN PATENT DOCUMENTS

| | | | |
|---|---|---|---|
| WO | 2016113432 | A1 | 7/2016 |
| WO | 2018189506 | A1 | 10/2018 |

*Primary Examiner* — Chi Q Nguyen

(74) *Attorney, Agent, or Firm* — Taft Stettinius & Hollister LLP

(57) ABSTRACT

An exemplary armature assembly is configured for use with a door closer comprising a pinion, and generally includes a first arm configured for rotational coupling with the pinion, a second arm pivotably coupled to the first arm at a pivot joint, and a hold-open mechanism. The hold-open mechanism generally includes a clutch having a decoupling and a coupling state, and an electromechanical driver operable to transition the clutch between the coupling state and the decoupling state. With the clutch in the decoupling state, a first torque is operable to cause relative pivoting of the arms. With the clutch in the coupling state, the first torque is inoperable to cause relative pivoting of the arms, and a second torque greater than the first torque is operable to cause relative pivoting of the arms.

31 Claims, 15 Drawing Sheets

(58) Field of Classification Search
CPC . Y10T 16/2804; Y10T 16/281; Y10T 16/285; Y10T 16/286; Y10T 16/62; H02P 7/24
USPC ..... 49/506, 404, 339, 340, 341, 346
See application file for complete search history.

(56) References Cited

U.S. PATENT DOCUMENTS 4,506,407 A 3/1985 Downey
4,750,236 A 6/1988 Teague, Jr.
4,878,265 A 11/1989 Nesbitt
5,044,680 A 9/1991 Baker et al.
5,048,150 A 9/1991 Guerin
5,072,973 A 12/1991 Gudgel et al.
5,511,284 A 4/1996 Curreat
5,878,530 A * 3/1999 Eccleston ..... E05F 15/77 49/139
6,904,643 B2 6/2005 Duffy
7,484,333 B2 * 2/2009 Houser ..... E05F 15/63 49/139
8,415,902 B2 * 4/2013 Burris ..... E05F 3/102 318/3
8,613,126 B2 * 12/2013 Blockley ..... E05F 3/12 16/71
8,695,163 B2 4/2014 Roberts
8,773,237 B2 * 7/2014 Burris ..... G05B 19/0426 340/3.32
8,779,713 B2 * 7/2014 Burris ..... E05F 15/70 318/466
8,966,712 B1 * 3/2015 Yu ..... E05F 3/02 16/66
10,077,591 B2 9/2018 Hass
10,202,789 B2 2/2019 Sowter
2006/0010771 A1 * 1/2006 Houser ..... E05F 15/63 49/341
2009/0265992 A1 * 10/2009 Hass ..... E05F 15/63 49/340
2011/0252697 A1 * 10/2011 Boensch ..... C11C 1/08 44/388
2013/0091768 A1 4/2013 Houser et al.
2016/0115725 A1 * 4/2016 Yulkowski ..... E05F 15/70 49/70
2018/0155968 A1 * 6/2018 Miu ..... E05C 17/006
2018/0258682 A1 * 9/2018 Schatz ..... E05F 15/616

* cited by examiner

DOOR OPERATOR HOLD-OPEN ARMATURE ASSEMBLY

TECHNICAL FIELD

The present disclosure generally relates to door closers, and more particularly but not exclusively relates to door closer armature assemblies operable to selectively retain a door in an open position.

BACKGROUND

Door closers are typically installed to closure assemblies to urge the door of the closure assembly toward its closed position. Occasionally, it may be desirable to selectively retain the door in an open position. Currently, there exist three primary mechanisms by which doors are retained in an open position. A first mechanism is a mechanical hold-open arm. These mechanisms typically require that the user set the hold-open angle to a single specified angle, manually engage the hold-open feature, and manually disengage the hold-open feature. A second mechanism is the electronic track arm, which also provide for single-point hold-open. While these electronic track arms may provide for remote disengagement, the number of configurations in which such mechanisms can be used is limited. A third mechanism is the electromagnetic hold-open, which likewise provides for single-point hold-open functionality. While these mechanisms can be remotely disengaged, they are separate components that are not integrated into the door closer, and require separate installation to the door.

Each of the above-described hold-open mechanisms suffers from one or more drawbacks or limitations. For example, each provides for single-point hold-open functionality, and the majority fail to provide for manual override in which the user can override the hold-open by simply pushing or pulling the door. Additionally, the electromagnetic solution is not integrated into the closer, and requires separate installation. For these reasons among others, there remains a need for further improvements in this technological field.

SUMMARY

An exemplary armature assembly is configured for use with a door closer comprising a pinion, and generally includes a first arm configured for rotational coupling with the pinion, a second arm pivotably coupled to the first arm at a pivot joint, and a hold-open mechanism. The hold-open mechanism generally includes a clutch having a decoupling and a coupling state, and an electromechanical driver operable to transition the clutch between the coupling state and the decoupling state. With the clutch in the decoupling state, a first torque is operable to cause relative pivoting of the arms. With the clutch in the coupling state, the first torque is inoperable to cause relative pivoting of the arms, and a second torque greater than the first torque is operable to cause relative pivoting of the arms. Further embodiments, forms, features, and aspects of the present application shall become apparent from the description and figures provided herewith.

DETAILED DESCRIPTION OF ILLUSTRATIVE EMBODIMENTS

Figure 1:
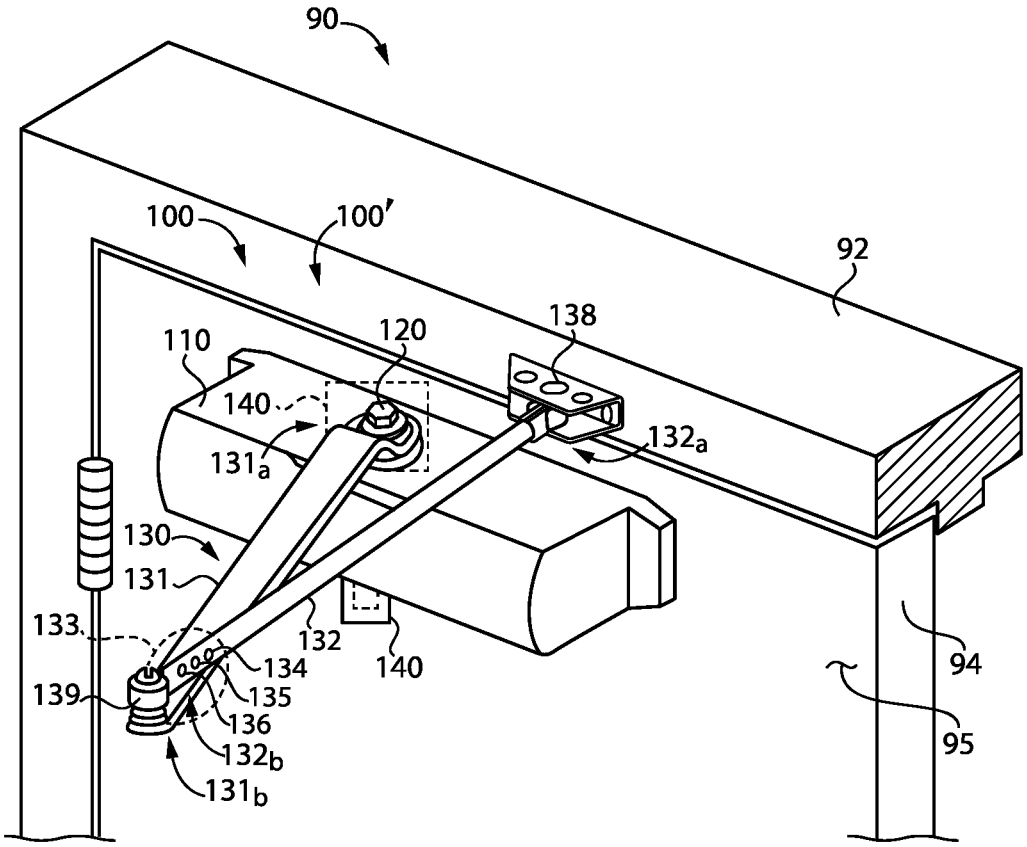
FIG. 1 is a perspective view of a door closer assembly according to certain embodiments installed to a closure assembly.

Although the concepts of the present disclosure are susceptible to various modifications and alternative forms, specific embodiments have been shown by way of example in the drawings and will be described herein in detail. It should be understood, however, that there is no intent to limit the concepts of the present disclosure to the particular forms disclosed, but on the contrary, the intention is to cover all modifications, equivalents, and alternatives consistent with the present disclosure and the appended claims.

References in the specification to "one embodiment," "an embodiment," "an illustrative embodiment," etc., indicate that the embodiment described may include a particular feature, structure, or characteristic, but every embodiment may or may not necessarily include that particular feature, structure, or characteristic. Moreover, such phrases are not necessarily referring to the same embodiment. It should further be appreciated that although reference to a "preferred" component or feature may indicate the desirability of a particular component or feature with respect to an embodiment, the disclosure is not so limiting with respect to other embodiments, which may omit such a component or feature. Further, when a particular feature, structure, or characteristic is described in connection with an embodiment, it is submitted that it is within the knowledge of one skilled in the art to implement such feature, structure, or characteristic in connection with other embodiments whether or not explicitly described.

Additionally, it should be appreciated that items included in a list in the form of "at least one of A, B, and C" can mean (A); (B); (C); (A and B); (B and C); (A and C); or (A, B, and C). Similarly, items listed in the form of "at least one of A, B, or C" can mean (A); (B); (C); (A and B); (B and C); (A and C); or (A, B, and C). Items listed in the form of "A, B, and/or C" can also mean (A); (B); (C); (A and B); (B and C); (A and C); or (A, B, and C). Further, with respect to the claims, the use of words and phrases such as "a," "an," "at least one," and/or "at least one portion" should not be interpreted so as to be limiting to only one such element unless specifically stated to the contrary, and the use of phrases such as "at least a portion" and/or "a portion" should be interpreted as encompassing both embodiments including only a portion of such element and embodiments including the entirety of such element unless specifically stated to the contrary.

In the drawings, some structural or method features may be shown in certain specific arrangements and/or orderings. However, it should be appreciated that such specific arrangements and/or orderings may not necessarily be required. Rather, in some embodiments, such features may be arranged in a different manner and/or order than shown in the illustrative figures unless indicated to the contrary. Additionally, the inclusion of a structural or method feature in a particular figure is not meant to imply that such feature is required in all embodiments and, in some embodiments, may be omitted or may be combined with other features.

The disclosed embodiments may, in some cases, be implemented in hardware, firmware, software, or a combination thereof. The disclosed embodiments may also be implemented as instructions carried by or stored on one or more transitory or non-transitory machine-readable (e.g., computer-readable) storage media, which may be read and executed by one or more processors. A machine-readable storage medium may be embodied as any storage device, mechanism, or other physical structure for storing or transmitting information in a form readable by a machine (e.g., a volatile or non-volatile memory, a media disc, or other media device).

With reference to FIG. 1, illustrated therein is a closure assembly 90 including a doorframe 92, a door 94 pivotably mounted to the doorframe 92, and a door closer assembly 100' according to certain embodiments. The door closer assembly 100' includes a door closer 100, which generally includes a closer body 110 and a pinion 120 rotatably mounted to the closer body 110. The door closer assembly 100' further includes an armature assembly 130 according to certain embodiments, and may further include a sensor module 140 according to certain embodiments and/or a control assembly 150. The illustrated hold-open armature assembly 130 generally includes a first arm 131 mounted to the pinion 120, a second arm 132 pivotably connected with the doorframe 92 via a shoe 138, and a pivot joint 139 pivotably coupling the first arm 131 and the second arm 132. The armature assembly 130 further includes an electromechanical hold-open mechanism 133 configured to selectively prevent relative pivoting of the first arm 131 and the second arm 132 to selectively retain the door 94 at each and any of a plurality of positions.

The door 94 is movable relative to the doorframe 92 between a fully-open position and a fully-closed position, and swings through a plurality of intermediate open positions between the fully-open position and the fully-closed position. As is typical of door closers, the door closer 100 facilitates the movement of the door 94 toward the closed position by exerting forces on the pinion 120, which forces are transmitted to the door by the armature assembly 130. More particularly, the door closer 100 is configured to urge the door 94 toward its closed position by causing the closer body 110 to urge the pinion 120 in a door-closing direction. Those skilled in the art will readily appreciate that rotation of the pinion 120 in the door-closing direction is correlated with closing of the door 94 by the armature 130. The closer body 110 may, for example, include a hydraulic system, a mechanical system, and/or an electromechanical system that provides the closer body 110 with the ability to exert the appropriate forces on the pinion 120. The closer body 110 may be provided as any of several conventional types of door closer that controls movement of a door by exerting forces on a rotatable pinion. Door closer bodies of this type are known in the art, and need not be described in further detail herein.

In the illustrated embodiment, the closer body 110 is mounted to the door 94, and the shoe 138 is mounted to the doorframe 92 such that the armature assembly 130 is connected between the pinion 120 and the doorframe 92. In other embodiments, the closer body 110 is mounted to the doorframe 92, and the shoe 138 is mounted to the door 94 such that the armature assembly 130 is connected between the pinion 120 and the doorframe 92. Thus, in certain embodiments, the door closer 100 is configured for mounting to a closure assembly 90 including a first structure and a second structure, and includes a body 110 configured for mounting to the first structure, a pinion 120 rotatably mounted to the body 110, and an armature 130 connected between the pinion 120 and the second structure, wherein one of the first structure or the second structure comprises a doorframe 92, and the other of the first structure or the second structure comprises a door 94 swingingly mounted to the doorframe 92. In certain embodiments, the closer body 110 may be concealed within the doorframe 92 or the door 94.

The illustrated armature assembly 130 is provided in a "standard" configuration, in which the arms 131, 132 extend away from the door 94 when the door 94 is in its closed position. It is also contemplated that the armature assembly 130 may be provided in a "parallel arm" configuration, in which the arms 131, 132 extend generally parallel to the face 95 of the door 94 when the door 94 is in its closed position.

The first arm 131 includes a first end portion **131*a* configured for connection with the pinion 120 and an opposite second end portion 131*b* engaged with the pivot joint 139. For example, the first end portion 131*a* may include an opening having a geometry corresponding to the geometry of the pinion 120 such that the first arm 131 is rotationally coupled with the pinion 120 when the pinion 120 is received in the opening. The second arm 132 includes a first end portion 132***a* pivotably coupled with the shoe 138 and an opposite second end portion 132*b* engaged with the pivot joint 139. The pivot joint 139 pivotably couples the second end portion 131*b* of the first arm 131 with the second end portion 132*b* of the second arm 132, and the hold-open mechanism 133 selectively prevents relative pivoting of the first arm 131 and the second arm 132 about the pivot joint 139 in a manner described herein.

The hold-open mechanism 133 generally includes a clutch 134 including an engagement member 135, and further includes an electromechanical driver 136 engaged with the engagement member 135. The hold-open mechanism 133 has a holding state and a releasing state. The driver 136 is operable to move the engagement member 135 between an engaging position and a disengaging position to transition the clutch 134 between a decoupling state corresponding to the releasing state of the hold-open mechanism 133 and a coupling state corresponding to the holding state of the hold-open mechanism 133. As described herein, the clutch 134 selectively prevents relative pivoting of the arms 131, 132 when in the coupling state, and permits relative pivoting of the arms 131, 132 when in the decoupling state. Additionally, the hold-open mechanism 133 is configured to transition from the holding state to the releasing state when a sufficient force is exerted on the door 94 to cause relative pivoting of the arms 131, 132. Certain illustrative examples of the armature assemblies including representative embodiments of the hold-open mechanism 133 are provided below with reference to FIGS. 3-21.

The sensor module 140 includes a rotational position sensor 142 operable to sense a rotational position of the pinion 120. An illustrative example of the sensor module 140 is provided below with reference to FIGS. 22 and 23, and certain alternative embodiments of the sensor module 140 are also described with reference to those figures. Regardless of the precise form of the sensor module 140, the sensor module 140 generates information relating to the rotational position of the pinion 120, and may further generate information relating to the speed and acceleration of the pinion 120 by tracking the position over time and the speed over time for the pinion 120.

Figure 2:
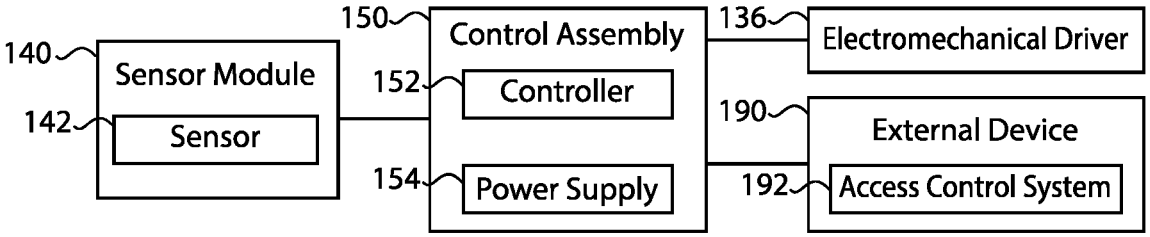
FIG. 2 is a schematic block diagram of a portion of the door closer assembly illustrated in FIG. 1.

With additional reference to FIG. 2, the control assembly 150 generally includes a controller 152, and may further include an onboard power supply 154. In addition or as an alternative to the onboard power supply 154, the control assembly 150 may be connected to or configured for connection with line power. As described herein, the control assembly 150 is in communication with the driver 136, and is configured to control operation of the driver 136 based upon one or more criteria. In certain embodiments, the control assembly 150 is further in communication with the sensor module 140 and/or an external device 190 such as an access control system 192, each of which may provide information relating to the one or more criteria.

Figure 4:
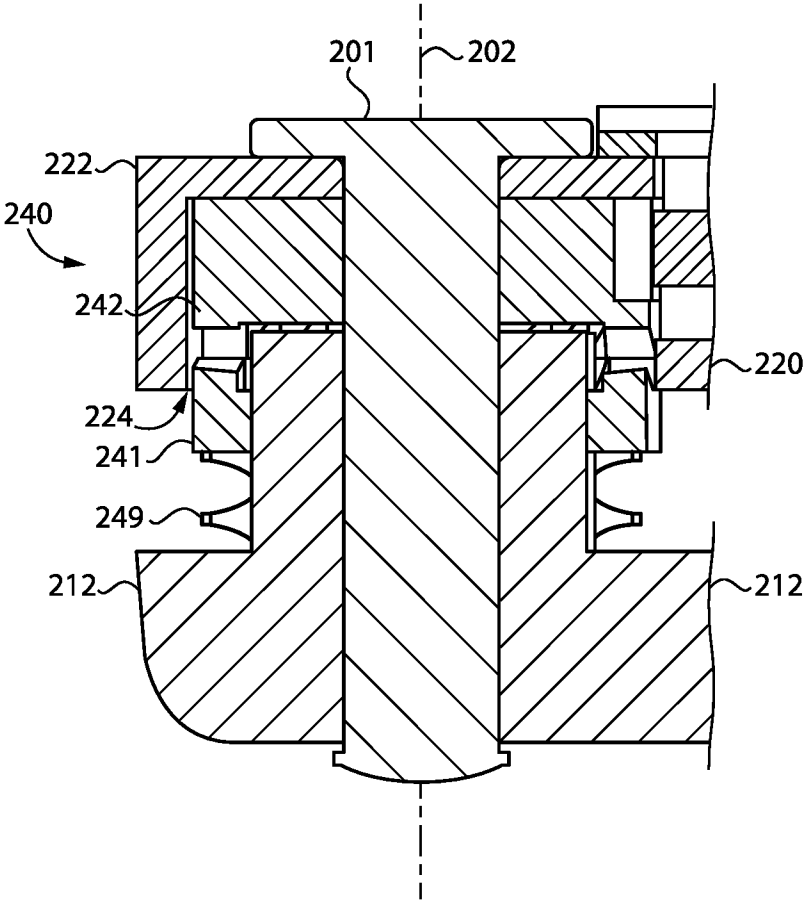
FIG. 4 is a cross-sectional view of the armature assembly illustrated in FIG. 3.
Figure 3:
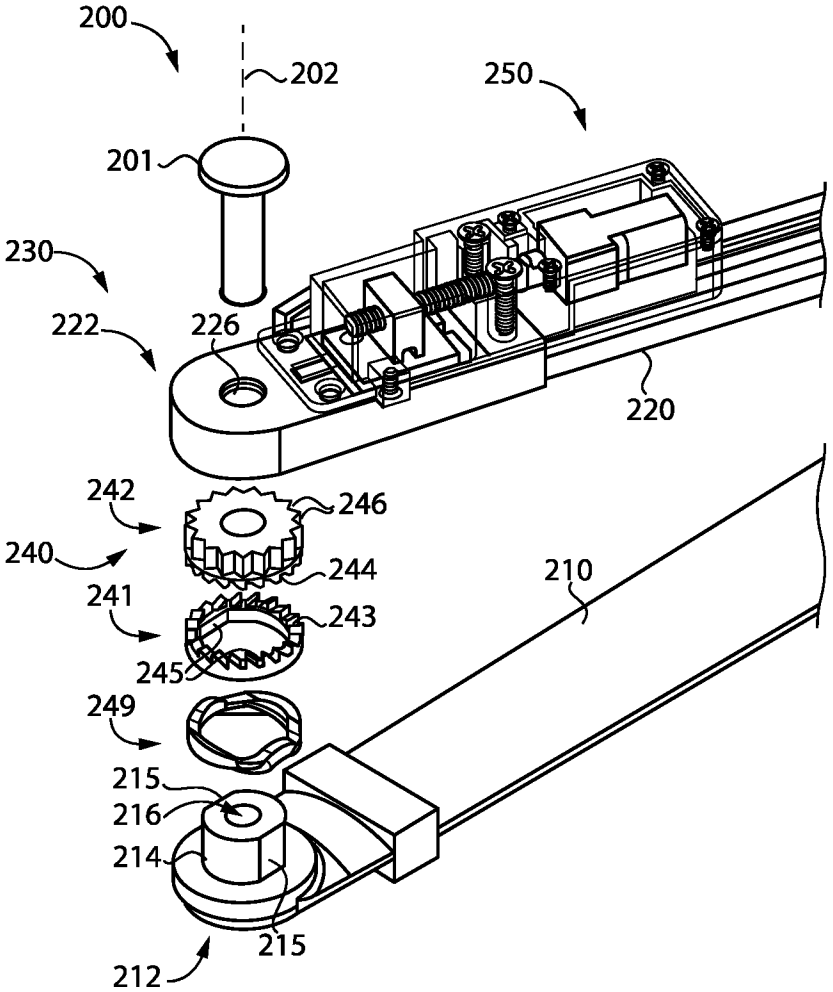
FIG. 3 is a partially-exploded assembly view of an armature assembly according to certain embodiments.

With additional reference to FIGS. 3 and 4, illustrated therein is an armature assembly 200 according to certain embodiments. The armature assembly 200 may, for example, be utilized as the armature assembly 130 of the door closer 100. The armature assembly 200 generally includes a first arm 210, a second arm 220 pivotably attached to the first arm 210 via a pivot pin 201 defining a pivot axis 202, and an electromechanical hold-open mechanism 230 configured to selectively prevent relative pivoting of the first arm 210 and the second arm 220. As described herein, the hold-open mechanism 230 generally includes a clutch 240 including a gear 242 and an engagement pin 250, an electromechanical driver 260 configured to drive the engagement pin 250 into and out of engagement with the gear 242, and a release mechanism 270 configured to selectively prevent the engagement pin 250 from engaging the gear 242.

The first arm 210 includes a first end portion configured for coupling with the pinion 120 and an opposite second end portion 212 engaged with the pivot pin 201. The second end portion 212 includes a post 214 configured for rotational coupling with a first ratchet member 241 of the clutch 240, and the pivot pin 201 extends through an opening 216 in the post 214.

The second arm 220 includes a first end portion pivotably coupled with the shoe 138 and an opposite second end portion 222 engaged with the pivot pin 201. The second end portion 222 defines a chamber 224 in which at least a portion of the clutch 240 is seated, and the pivot pin 201 extends through an opening 226 defined in the second end portion 222.

The clutch 240 generally includes a first ratchet member or ratchet ring 241, a second ratchet member or ratchet gear 242 engaged with the first ratchet member 241, and a biasing mechanism 249 urging the ratchet members 241, 242 into contact with one another. The ratchet ring 241 is rotationally coupled with the post 214 for joint rotation about the pivot axis 202. While other forms of rotational coupling are contemplated, in the illustrated form, the post 214 includes one or more flats 215, and the ratchet ring 241 includes a corresponding pair of flats 245 that engage the flats 215 to prevent relative rotation of the post 214 and the ratchet ring 241. The ratchet gear 242 also includes a set of tapered teeth 246, which interface with the tapered nose 255 of the engagement pin 250 as described herein. The ratchet gear 242 is an example of a transmission component, and as described herein, is coupled with the first arm 210 for joint rotation in one direction while being rotatable relative to the first arm 210 in a second direction opposite the first direction.

The first ratchet member 241 includes a first set of ratchet teeth 243, and the second ratchet member 242 includes a corresponding set of second ratchet teeth 244 engaged with the first ratchet teeth 243. As described in further detail below, the ratchet teeth 243, 244 are oriented to permit relative rotation of the ratchet members 241, 242 in a first rotational direction corresponding to opening movement of the door 94, and to prevent relative rotation of the ratchet members 241, 242 in a second rotational direction corresponding to closing movement of the door 94. In the illustrated form, the biasing mechanism 249 is provided in the form of a compression spring, and more particularly in the form of a wave spring. It is also contemplated that the biasing mechanism 249 may be provided in another form, such as that of another type of compression spring, an extension spring, a torsion spring, a leaf spring, an elastic member, and/or one or more magnets.

Figure 5:
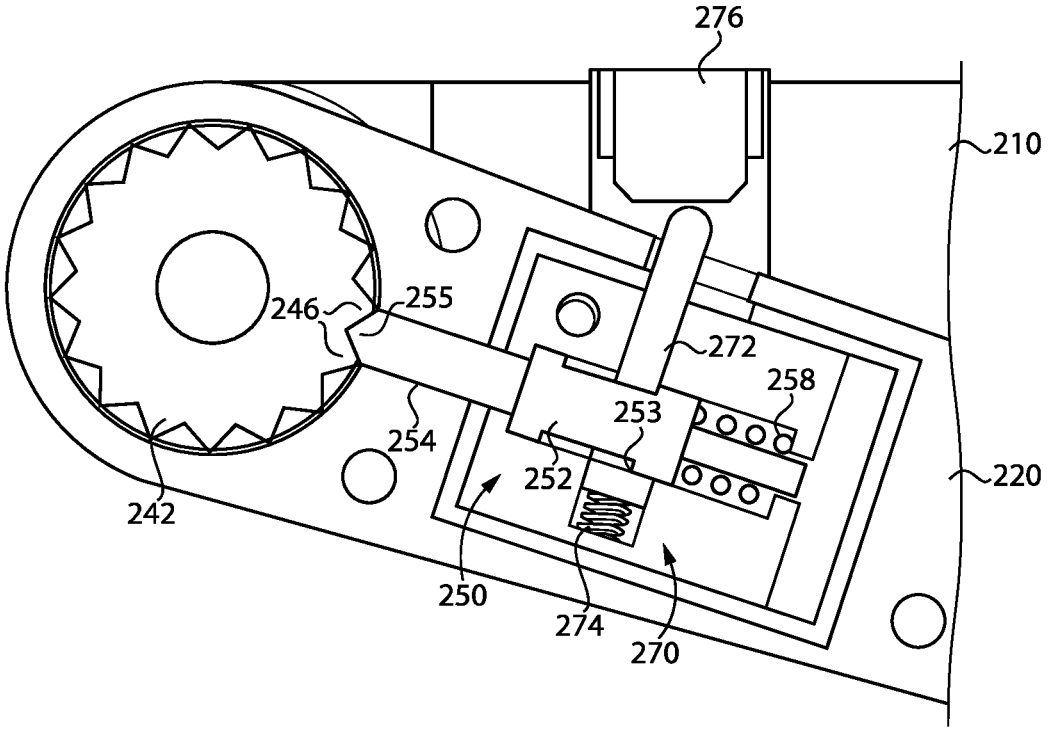
FIG. 5 is a cutaway plan view of a portion of the armature assembly illustrated in FIG. 3.

With additional reference to FIG. 5, the illustrated engagement pin 250 is mounted within the second arm 220, and generally includes a body portion 252 defining a shoulder 253, a post 254 extending from the body portion 252 to a tapered nose 255, and a stem 256 having an override spring 258 mounted thereon. The engagement pin 250 has an engaging position in which the tapered nose 255 engages the tapered teeth 246 and a disengaging position in which the tapered nose 255 disengages from the ratchet gear 242, and the override spring 258 biases the engagement pin 250 toward the engaging position. In the illustrated form, the override spring 258 is provided in the form of a compression spring. In other embodiments, the override spring 258 may be provided as another form of biasing mechanism, such as a torsion spring, a leaf spring, an extension spring, magnets, or an elastic member. As described herein, the strength of the override spring 258 corresponds to the override force required to move the door 94 from its held position when the hold-open mechanism 230 is in its holding state.

When in the engaging position, the engagement pin 250 releasably rotationally couples the second ratchet member 242 with the second arm 220. More particularly, the tapered nose 255 is positioned between a pair of the tapered teeth 246, and the override spring 258 maintains such engagement between the nose 255 and the teeth 246. Should a torque be applied to the second ratchet member 242, the engagement pin 250 will therefore resist rotation of the second ratchet member 242 by generating a resistive torque. When the applied torque reaches a threshold level sufficient to drive the pin 250 rearward against the force of the override spring 258, the applied torque overcomes the resistive torque. Thus, an applied torque beyond the threshold level will be sufficient to cause the second ratchet member 242 to rotate relative to the second arm 220. Should the engagement pin 250 be held in its disengaging position (e.g., by the driver 260 and/or the release mechanism 270), the second ratchet member 242 will remain free to rotate relative to the second arm 220.

Figure 6:
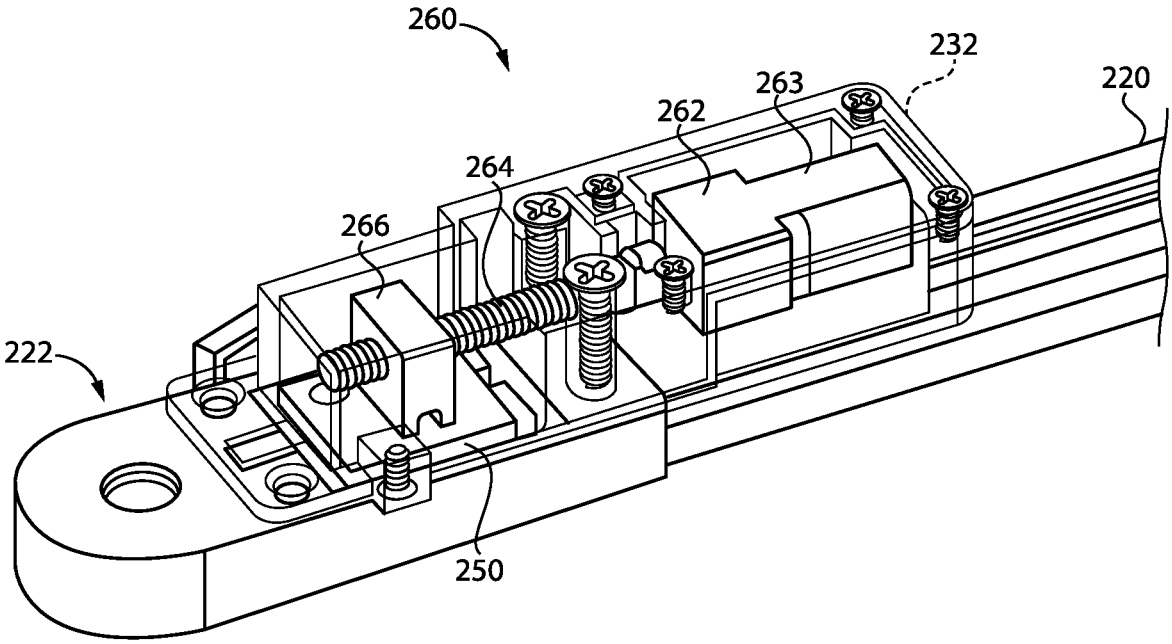
FIG. 6 is a perspective view of a portion of the armature assembly illustrated in FIG. 3.
Figure 7:
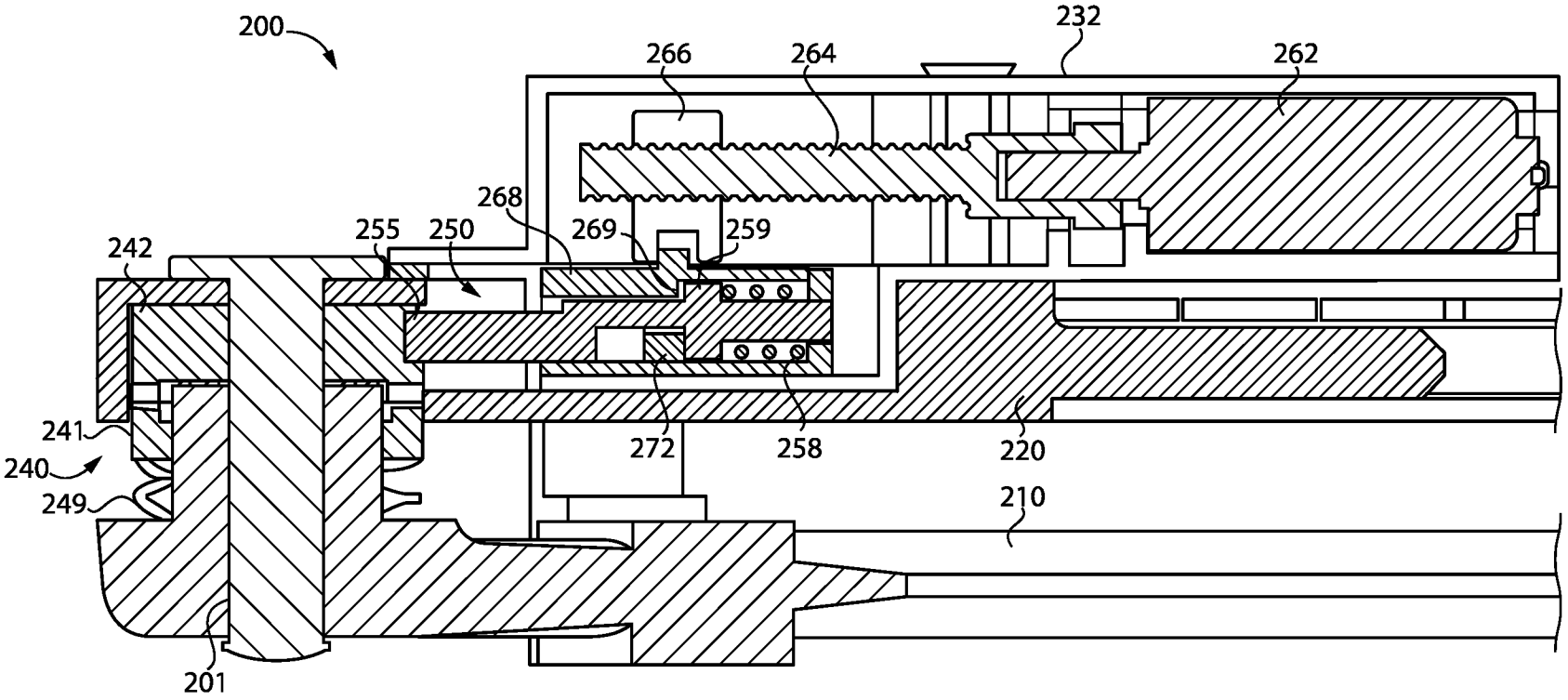
FIG. 7 is another cross-sectional view of the armature assembly illustrated in FIG. 3.

With additional reference to FIGS. 6 and 7, the electromechanical driver 260 is mounted to the second arm 220 within a housing 232, and generally includes a body portion 262, a shaft 264 that extends from the body portion 262, and a coupler 266 engaged between the shaft 264 and the engagement pin 250 such that the driver 260 is operable to drive the engagement pin 250 between its engaging position and its disengaging position. The electromechanical driver 260 of the current embodiment may alternatively be referred to as a linear actuator. The coupler 266 may be engaged with the engagement pin 250 via a one-way push interface that enables the coupler 266 to retain the engagement pin 250 in its disengaging position when the coupler 266 is in a first position corresponding to the release state, and which enables the engagement pin 250 to travel between its engaging position and its disengaging position when the coupler 266 is in a second position corresponding to the holding state. For example, a slide plate 268 may be mounted between the coupler 266 and the engagement pin 250, and a shoulder 269 of the slide plate 268 may engage a shoulder 259 of the engagement pin 250 to drive the engagement pin 250 rearward against the force of the override spring 258 as the coupler 266 moves from its second position to its first position.

In the illustrated form, the body portion 262 of the electromechanical driver 260 is provided as a motor 263, and the shaft 264 is provided as a threaded shaft that is threadedly engaged with the coupler 266. More particularly, the motor 263 is operable to rotate the shaft 264 such that the threaded engagement between the shaft 264 and the coupler 266 linearly drives the coupler 266 and the engagement pin 250 as the shaft 264 rotates. In other embodiments, the threaded shaft 264 is engaged with a threaded rotor of the motor 263 such that rotation of the rotor linearly drives the shaft 264. In further embodiments, the body portion 262 may be provided as a solenoid core that linearly drives the shaft 264 between extended and retracted positions as the solenoid core is energized and de-energized. Regardless of the precise form of the driver 260, the driver 260 may be operable to move the engagement pin 250 from its engaging position to its disengaging position against the biasing force of the override spring 258. The driver 260 may be in communication with the control assembly 150 and/or the external device 190 such that operation of the driver 260 can be controlled by the control assembly 150 and/or the external device 190.

The release mechanism 270 generally includes a release pin 272 having a projected position and a depressed position, a biasing member 274 biasing the release pin 272 to its projected position, and a bracket 276 operable to drive the release pin 272 to its depressed position against the force of the biasing member 274. When in the projected position, the release pin 272 engages the shoulder 253 of the engagement pin 250 and retains the pin 250 in its rearward disengaging position. When in the depressed position, the release pin 272 disengages from the shoulder 253 and permits extension of the engagement pin 250 to its forward engaging position. The bracket 276 is mounted to the first arm 210, and drives the release pin 272 to its depressed position as the door 94 reaches its closed position. While the illustrated biasing member 274 is provided in the form of a compression spring, it is also contemplated that the biasing member 274 may be provided in another form, such as that of a torsion spring, a leaf spring, an extension spring, magnets, or an elastic member. As described herein, the release mechanism 270 is configured to selectively retain the engagement pin 250 in its disengaging position upon manual override of the held condition.

As noted above, the armature assembly 200 is one embodiment of the armature assembly 130, and thus may be utilized as the armature assembly 130 in the door closer assembly 100'. In such forms, the armature assembly 200 is configured to selectively hold the door 94 in any desired position, such as the closed position or any of the open positions. As the door 94 moves in its opening direction, the arms 210, 220 pivot relative to one another in a first rotational direction, which may also be referred to as the opening direction. During such pivotal movement of the arms 210, 220 in the opening direction, the lower ratchet teeth 243 travel along the upper ratchet teeth 244 while the biasing mechanism 249 maintains engagement between the ratchet ring 241 and the ratchet gear 242. As noted above, the ratchet teeth 243, 244 are oriented to permit such relative rotation of the ratchet members 241, 242, and thus permit relative pivoting of the arms 210, 220 even in the event that the second ratchet member 242 is rotationally coupled with the second arm 220 (e.g., by the engagement pin 250).

When the door 94 is released by the user, the closer body 110 urges the pinion 120 to rotate in the door-closing direction, thereby causing relative pivoting of the arms 210, 220 in a closing direction opposite the opening direction. As noted above, the ratchet teeth 243, 244 are oriented to prevent such relative rotation of the ratchet members 241, 242, and thereby rotationally couple the second ratchet member 242 with the first arm 210. When the engagement pin 250 is held in its releasing position (e.g., by the driver 260 and/or the release mechanism 270), the rotational coupling provided by the ratchet teeth 243, 244 will cause the second ratchet member 242 to rotate with the first ratchet member 241 as the door 94 closes. Thus, when the hold-open mechanism 230 is in its releasing state, the door 94 will be free to close as normal.

Should the hold-open mechanism 230 be in its holding state, release of the door 94 will cause the closure assembly 90 to transition to a held condition, in which the armature assembly 200 holds the door 94 in the last position to which it was moved by generating a resistive torque that counteracts the biasing torque provided by the closer 100. When the hold-open mechanism 230 is in its holding state, the driver 260 permits the engagement pin 250 to move to its engaging position under the biasing force of the override spring 258. As a result, the engagement pin 250 releasably rotationally couples the second ratchet member 242 with the second arm 220 in the manner described above. Thus, in the absence of a threshold torque, the hold-open mechanism 230 prevents relative pivoting of the arms 210, 220 in the closing direction, thereby maintaining the door 94 in its held position against the closing force provided by the closer body 110.

As noted above, when a threshold torque is applied to the second ratchet member 242, engagement between the tapered teeth 246 and the tapered nose 255 overcomes the resistive torque and urges the engagement pin 250 toward its disengaging position against the force of the override spring 258. A user may manually apply such a threshold torque to the clutch 240 by exerting a sufficient force urging the door 94 in either the opening direction or the closing direction. Upon exertion of such a force, the engagement pin 250 travels to its disengaging position, thereby permitting the release pin 272 to move to its projected position under the urging of the biasing member 274. With the release pin 272 in its projected position, the release pin 272 engages the shoulder 253 of the engagement pin 250 such that the release pin 272 retains the engagement pin 250 in its disengaging position against the force of the override spring 258. With the release mechanism 270 maintaining the engagement pin 250 in its disengaging position, the second ratchet member 242 is free to rotate relative to the second arm 220. As a result, the resistive torque is reduced or eliminated, and the door 94 is free to move to its closed position under the urging of the closer body 110. Thus, the hold-open mechanism 230 is configured to transition from its holding state to its releasing state in response to a threshold force being applied to the door 94.

As described above, the release mechanism 270 selectively retains the engagement pin 250 in its disengaging position when a user transitions the hold-open mechanism 230 to its releasing state by exerting a threshold force on the door 94. As a result, the door 94 is free to travel to its closed position under the urging of the closer body 110. As the door 94 moves to its closed position, the arms 210, 220 scissor closed such that the bracket 276 mounted to the first arm 210 depresses the release pin 272, thereby transitioning the release mechanism 270 to its releasing state in which the release mechanism 270 releases the engagement pin 250. Thus, when the coupler 266 is in its second position, the engagement pin 250 travels to the engaging position to ready the armature assembly 200 for another open/close cycle.

Figure 8:
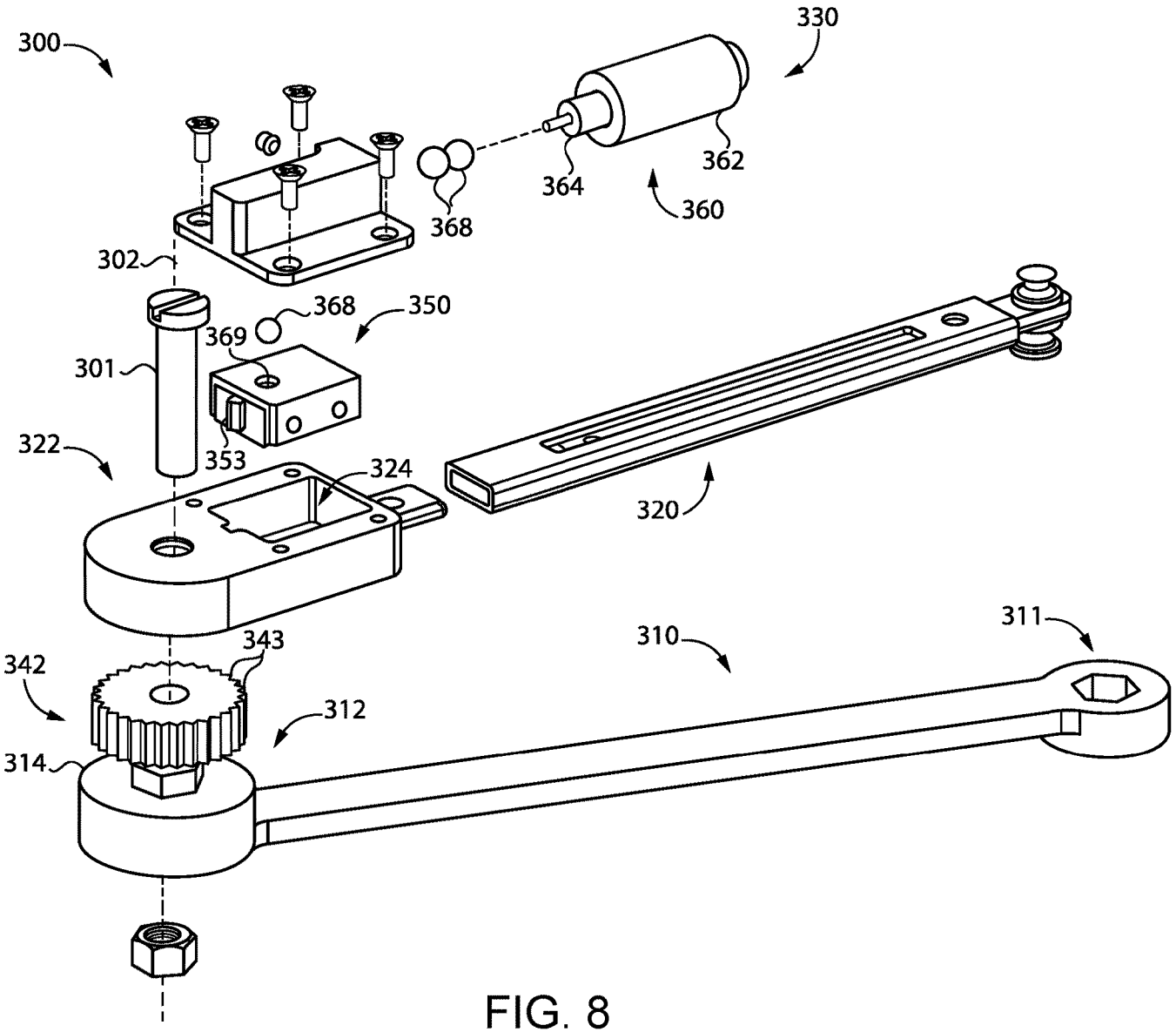
FIG. 8 is an exploded assembly view of an armature assembly according to certain embodiments.
Figure 10:
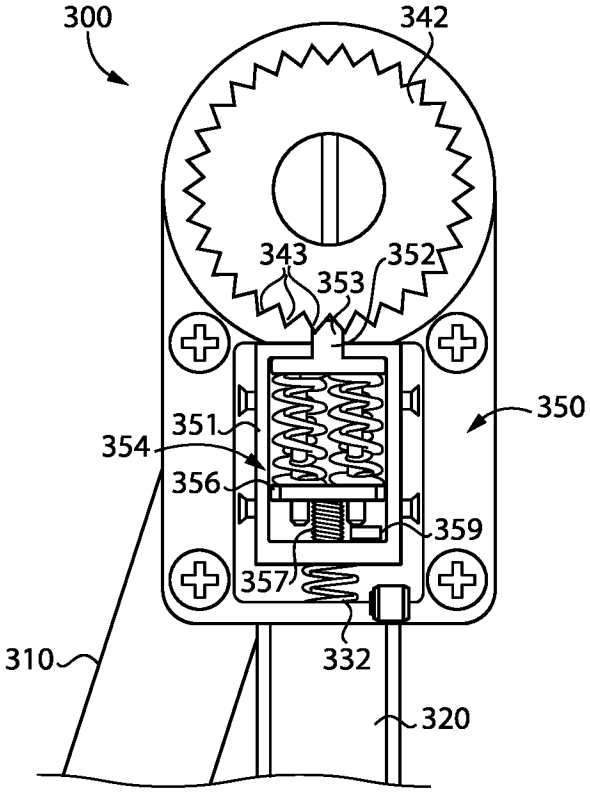
FIG. 10 is a cutaway plan view of a portion of the armature assembly illustrated in FIG. 8.
Figure 9:
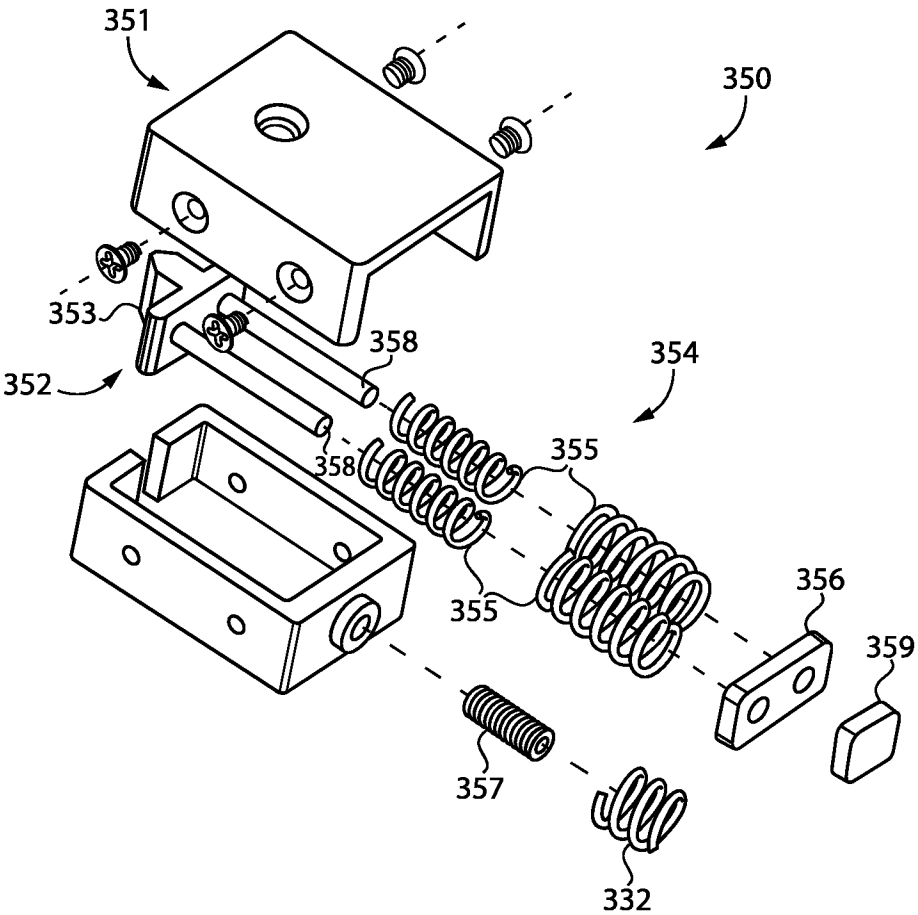
FIG. 9 is an exploded assembly view of a portion of the armature assembly illustrated in FIG. 8.
Figure 11:
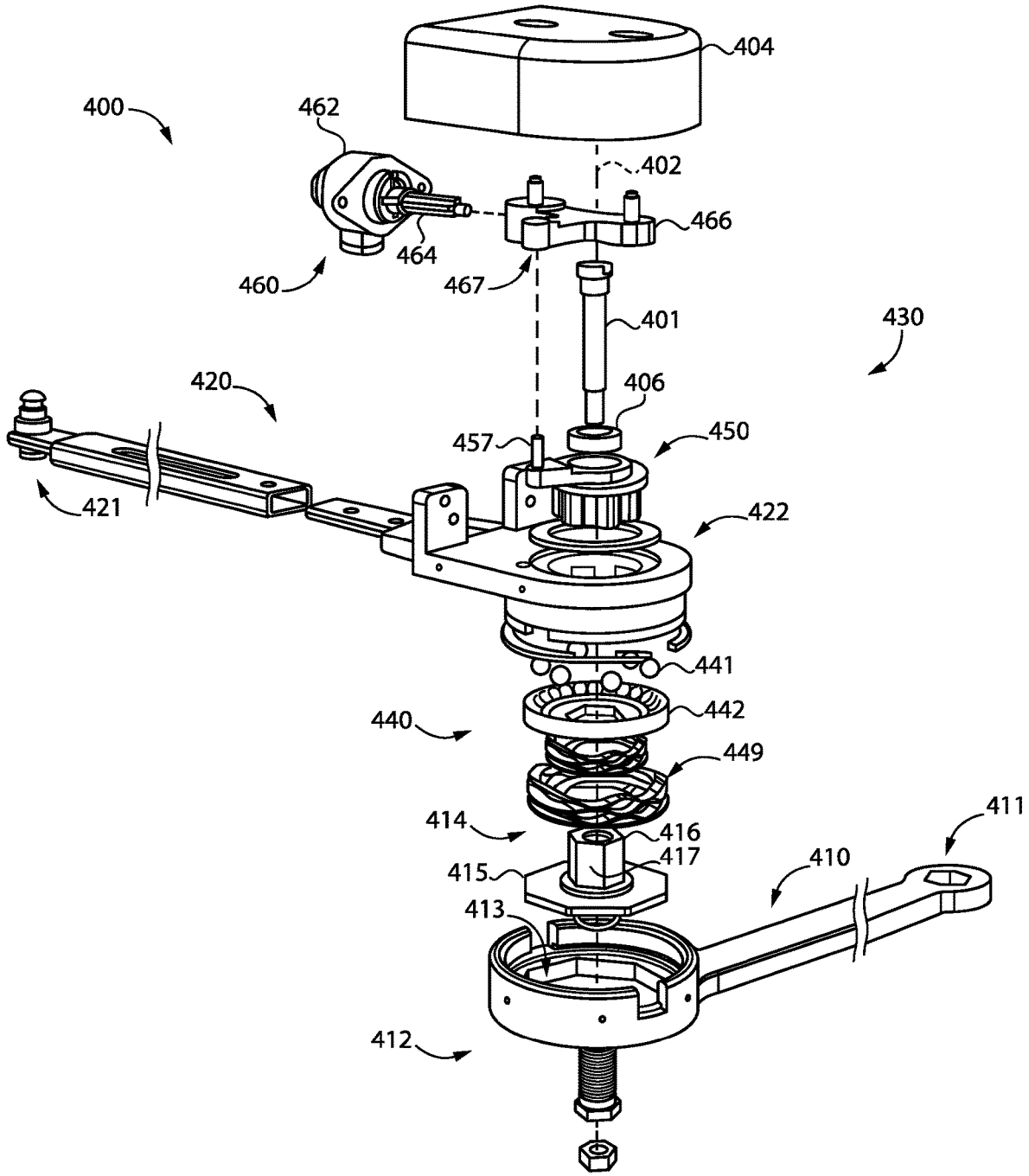
FIG. 11 is an exploded assembly view of an armature assembly according to certain embodiments.
Figure 12:
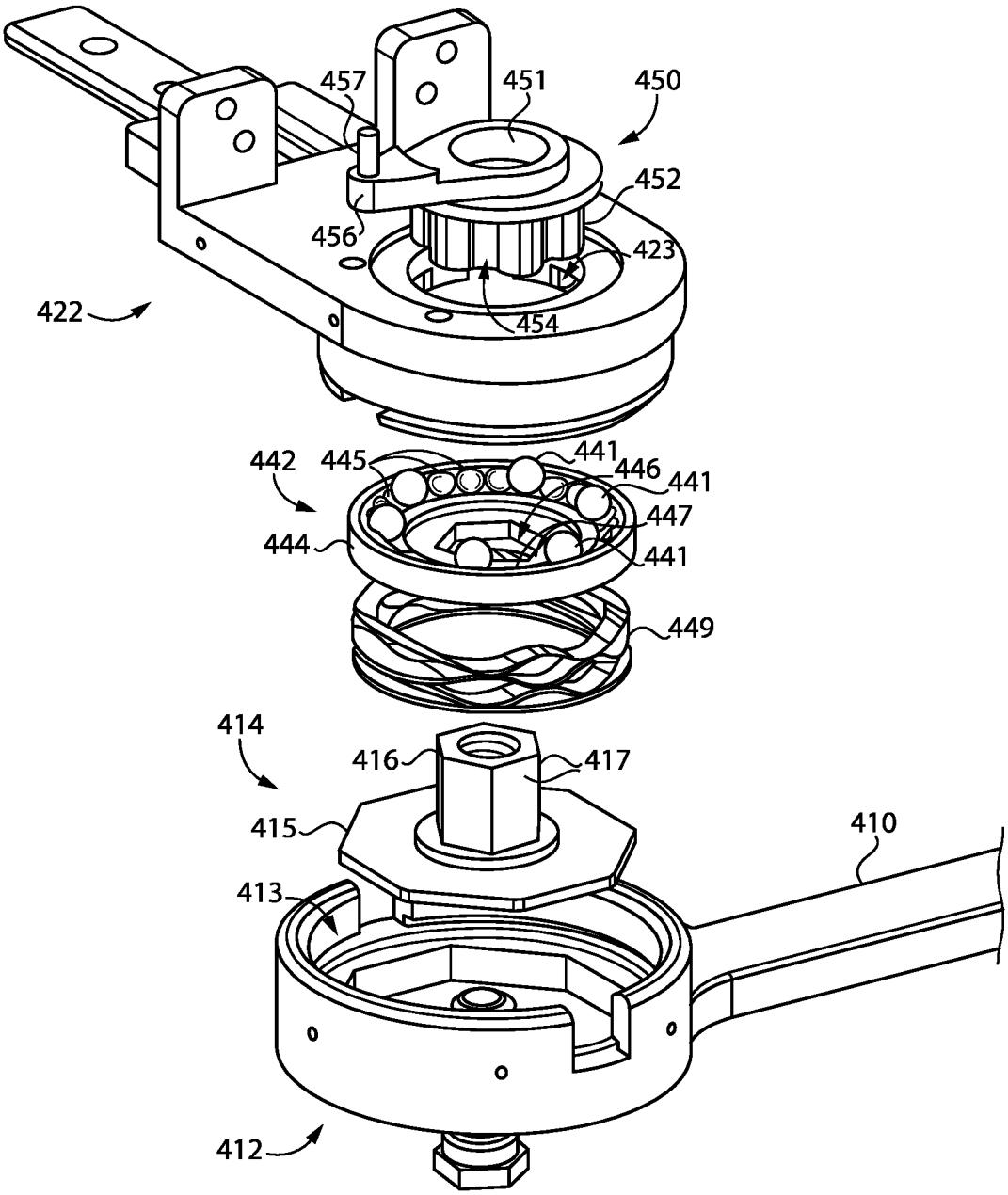
FIG. 12 is an exploded assembly view of a portion of the armature assembly illustrated in FIG. 11.
Figure 13:
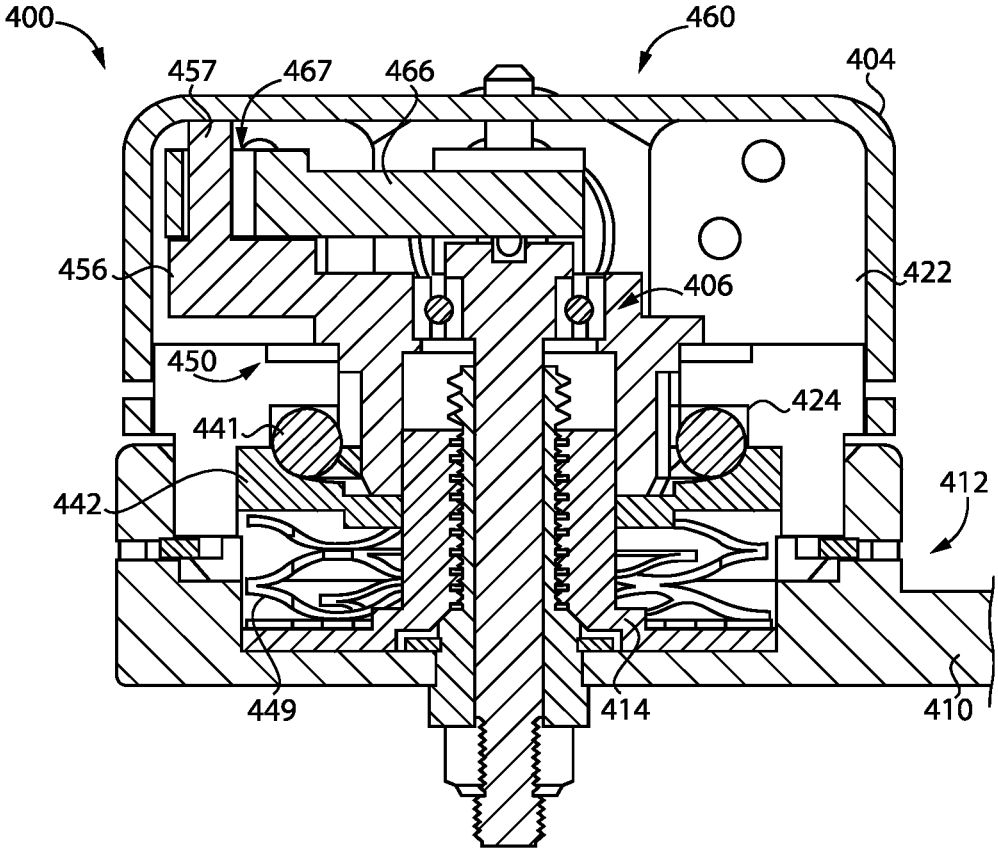
FIG. 13 is a cross-sectional view of a portion of the armature assembly illustrated in FIG. 11.

With additional reference to FIG. 8-10, illustrated therein is an armature assembly 300 according to certain embodiments. The armature assembly 300 may, for example, be utilized as the armature assembly 130 of the door closer 100. The armature assembly 300 generally includes a first arm 310, a second arm 320 pivotably attached to the first arm 310 via a pivot pin 301 defining a pivot axis 302, and an electromechanical hold-open mechanism 330 configured to selectively prevent relative pivoting of the first arm 310 and the second arm 320. As described herein, the hold-open mechanism 330 generally includes a clutch 340 including a transmission component such as a gear 342 and an engagement assembly 350, and further includes an electromechanical driver 360 operable to transition the clutch 340 between a holding state and a releasing state.

The first arm 310 includes a first end portion 311 configured for coupling with the pinion 120 and an opposite second end portion 312 engaged with the pivot pin 301. The second end portion 312 includes a post 314 configured for rotational coupling with a gear 342 of the clutch 340, and the pivot pin 301 extends through an opening in the post 314.

The second arm 320 includes a first end portion 321 pivotably coupled with the shoe 138 and an opposite second end portion 322 engaged with the pivot pin 301. The second end portion 322 defines a chamber 324 in which at least a portion of the hold-open mechanism 330 is seated, and the pivot pin 301 extends through an opening 326 defined in the second end portion 322.

As noted above, the hold-open mechanism 330 generally includes a clutch 340 including a gear 342 and an engagement assembly 350, and further includes an electromechanical driver 360 operable to transition the clutch 340 between a holding state and a releasing state. The engagement assembly 350 has an engaged position and a disengaged position, and is biased toward the engaged position by a biasing mechanism 332 mounted within the chamber 324. While the illustrated biasing mechanism 332 is provided in the form of a compression spring, it is also contemplated that the biasing mechanism 332 may be provided in another form, such as that of a torsion spring, a leaf spring, an extension spring, magnets, or an elastic member.

The clutch 340 generally includes a gear 342 and an engagement assembly 350 operable to selectively prevent rotation of the gear 342. The gear 342 is rotationally coupled with the first arm 310, and includes a plurality of tapered teeth 343 that engage a tapered nose 353 of the engagement assembly 350. As described herein, the engagement assembly 350 selectively and releasably rotationally couples the gear 342 with the second arm 320.

The engagement assembly 350 generally includes a housing 351 and a pin mechanism 352 defining a tapered nose 353 that projects from the housing 351. The pin mechanism 352 is movable relative to the housing 351 between a home position and an override position, and an override spring mechanism 354 biases the pin mechanism 352 toward its home position. The override spring mechanism 354 is engaged between the pin mechanism 352 and an adjustment plate 356. The adjustment plate 356 is engaged with the housing 351 via a set screw 357 such that the position of the adjustment plate 356 within the housing 351 is adjustable. Adjustment of the position of the plate 356 adjusts the biasing force generated by the override spring mechanism 354 by compressing or expanding the springs 355 of the override spring mechanism 354, which are mounted to posts 358 of the pin mechanism 352. While the illustrated override spring mechanism 354 includes biasing members in the form of compression springs 355, it is also contemplated that the biasing members of the override spring mechanism 354 may be provided in another form, such as that of a torsion spring, a leaf spring, an extension spring, magnets, or an elastic member. For reasons described herein, the stiffness of the override spring mechanism 354 is greater than that of the spring 332, and corresponds to the override force required to manually transition the hold-open mechanism 330 from its holding state to its releasing state.

The engagement assembly 350 may further include a position sensor 359 operable to sense the home/override position of the pin mechanism 352. While other forms are contemplated, in the illustrated form, the sensor 359 is provided in the form of a switch that is actuated or deactuated by engagement with the posts 358 when the pin mechanism 352 is in its depressed or override position. The sensor 359 may, for example, be provided as a mechanical switch, an optical switch, a Hall effect sensor, or another form of sensor operable to sense the home/override position of the pin mechanism 352.

The electromechanical driver 360 is another example of a linear actuator that may be utilized in certain embodiments, and in the illustrated form is provided in the form of a solenoid 361. The solenoid 361 includes a solenoid core 362 and a plunger 364 mounted within the core 362 such that energizing and de-energizing the core 362 drives the plunger 364 between an extended position and a retracted position. In the illustrated form, energization of the core 362 drives the plunger 364 to its extended position, in which the plunger 364 interfaces with one or more ball bearings 368 to retain the engagement assembly 350 in its engaging position. More particularly, one of the ball bearings 368 engages a depression 369 formed in the housing 351 of the engagement assembly 350 and prevents movement of the housing 351 from the position to which the housing 351 is biased by the biasing mechanism 332. The driver 360 may be in communication with the control assembly 150 and/or the external device 190 such that operation of the driver 360 can be controlled by the control assembly 150 and/or the external device 190.

As with the above-described clutch 240, when the tapered nose 353 is engaged with the gear 342, interference between the tapered teeth 343 and the tapered nose 353 provides a resistive torque that resists rotation of the gear 342 relative to the second arm 320. When the engagement assembly 350 is free to move between its engaging position and its disengaging position (e.g., when the solenoid 361 is in its de-energized state), the resistive torque corresponds to the stiffness of the relatively light primary spring 332. As a result, the resistive torque is relatively low, and the gear 342 is substantially rotationally decoupled from the second arm 320 such that even a relatively low torque (e.g., the torque generated by the closer 100) is capable of causing relative pivoting of the arms 310, 320. By contrast, when the engagement assembly 350 is retained in its engaging position (e.g., when the solenoid 361 is in its energized state), the resistive torque corresponds to the stiffness of the relatively heavy override spring mechanism 354. As a result, the resistive torque is relatively high, and the gear 342 is releasably rotationally coupled with the second arm 320 such that the closer 100 cannot drive the door 94 to its closed position. Those skilled in the art will nonetheless appreciate that upon application of a threshold torque, the pin mechanism 352 will travel to a depressed position against the urging of the override spring mechanism 354.

Operation of the armature assembly 300 is somewhat similar to the operation of the armature assembly 200, in that the hold-open mechanism 330 selectively prevents relative rotation of the arms 310, 320 by selectively rotationally coupling the gear 342 with the second arm 320 such that a resistive torque is generated. During opening of the door 94, the solenoid 361 is maintained in its de-energized state such that the engagement assembly 350 is free to move between its engaging position and its disengaging position. As a result, the relatively low resistive torque provided by the hold-open mechanism 330 does not appreciably interfere with opening of the door 94.

Upon release of the door 94 (or satisfaction of one or more additional or alternative release criteria such as those described herein), the solenoid 361 is energized. Energization of the solenoid 361 may be based in part upon information received from the sensor module 140. For example, the solenoid 361 may be energized when the information from the sensor module 140 indicates that the door 94 has stalled in an open position, or has begun returning toward its closed position. Upon energization of the solenoid 361, the driver 360 retains the engagement assembly 350 in its engaging position. As a result, the hold-open mechanism 330 releasably rotationally couples the gear 342 with the second arm 320, thereby selectively preventing relative pivoting of the arms 310, 320 in the closing direction. With relative pivoting of the arms 310, 320 prevented, the door 94 is maintained in the last position to which it was moved, whether that be the fully open position, an intermediate position, or the closed position.

As with the armature assembly 200, the hold-open mechanism 330 of the armature assembly 300 is configured to transition from the holding state to the releasing state in response to a sufficient force being exerted on the door 94. For example, should a user exert on the door 94 a pushing force or pulling force sufficient to provide the clutch gear 342 with the threshold torque, the gear 342 will urge the pin mechanism 352 to its depressed position against the force of the override spring mechanism 354. When this occurs, the sensor 359 may be actuated (e.g., by engagement with one of the posts 358) and/or the position sensor 140 may indicate that some rotation of the pinion 120 has occurred. In either event, the control assembly 150 may cut power to the solenoid 361. With the solenoid 361 de-energized, the engagement assembly 350 is again free to move between its engagement and disengagement positions such that the door 94 is free to move to its closed position under the biasing force generated by the closer body 110. When the door 94 returns to its home or closed position (e.g., as indicated by the position sensor 140), the control assembly 150 may reset in preparation for the next open/close cycle.

With additional reference to FIGS. 11-15, illustrated therein is an armature assembly 400 according to certain embodiments. The armature assembly 400 may, for example, be utilized as the armature assembly 130 of the door closer 100. The armature assembly 400 generally includes a first arm 410, a second arm 420 pivotably attached to the first arm 410 via a pivot pin 401 defining a pivot axis 402, and an electromechanical hold-open mechanism 430 configured to selectively prevent relative pivoting of the first arm 410 and the second arm 420. As described herein, the hold-open mechanism 430 generally includes a clutch 440 including an engagement member 450, and further includes an electromechanical driver 460 operable to transition the clutch 440 between a holding state and a releasing state.

The first arm 410 includes a first end portion 411 configured for coupling with the pinion 120 and an opposite second end portion 412 engaged with the pivot pin 401. The second end portion 412 defines a chamber 413 in which a portion of the hold-open mechanism 430 is seated. The second end portion 412 is rotationally coupled with a retention plate 442 of the clutch 440 via a post member 414 including a plate 415 and a post 416 projecting from the plate 415. The plate 415 is sized and shaped for rotational coupling with a recessed portion of the chamber 413 such that the post member 414 is rotationally coupled with the second end portion 412. The post 416 may include flats 417 that engage flats 447 on the retention plate 442 to rotationally couple the post member 414 with the retention plate 442 while permitting axial movement of the retention plate 442 along the pivot axis 402. The pivot pin 401 extends through an opening in the post 416 such that the second end portion 412 is operable to pivot about the pivot axis 402.

The second arm 420 includes a first end portion 421 pivotably coupled with the shoe 138 and an opposite second end portion 422 mounted for rotation about the pivot pin 401. The second end portion 422 defines a chamber 423 in which at least a portion of the hold-open mechanism 430 is seated, and the chamber 423 includes a plurality of tapered recesses 424.

As noted above, the hold-open mechanism 430 generally includes a clutch 440 including an engagement member 450, and further includes an electromechanical driver 460 operable to transition the clutch 440 between a holding state and a releasing state. As described herein, the hold-open mechanism 430 is configured to selectively prevent relative pivoting of the arms 410, 420 about the pivot axis 402.

The clutch 440 includes the engagement member 450, and further includes the retention plate 442 and one or more spherical roller bearings 441. The retention plate 442 includes a generally annular portion 444 having a plurality of depressions 445 sized and shaped to receive the roller bearings 441. A central opening 446 is defined in the retention plate 442, and is defined in part by one or more flats 447. The opening 446 receives the post 416, and the flats 447 engage the flats 417 such that the retention plate 442 is slidable along the pivot axis 402 between an upper position and a lower position, and such that the retention plate 442 is rotationally coupled with the first arm 410 via the post member 414. The retention plate 442 is an example of a transmission component rotationally coupled with the first arm 410. An override spring mechanism 449 is engaged between the post member 414 and the retention plate 442, and urges the retention plate 442 toward its upper position. In the illustrated form, the override spring mechanism 449 is provided in the form of plural compression springs, and more particularly as a pair of wave springs. It is also contemplated that the biasing members of the override spring mechanism 449 may be provided in another form, such as that of another type of compression spring, an extension spring, a torsion spring, a leaf spring, an elastic member, and/or one or more magnets.

The engagement member 450 is rotatably mounted to the pin 401, and extends into the chamber 423 defined by the second arm 420. The engagement member 450 is rotatable about the pivot axis 402 between a disengaging position (FIG. 14) and an engaging position (FIG. 15), and in certain embodiments, a bearing 406 may be engaged between the pin 401 and the engagement member 450 to facilitate such rotation. The engagement member 450 generally includes a plurality of angularly-spaced projections 452 having recesses 454 defined therebetween. The engagement member 450 may further include a radial arm 456 defining a post 457 by which the engagement member 450 is engaged with the driver 460.

The electromechanical driver 460 is mounted to the second arm 420 within a housing 404, and generally includes a body portion 462, a shaft 464 that extends from the body portion 462, and a coupler 466 engaged between the shaft 464 and the engagement member 450 such that the driver 460 is operable to drive the engagement member 450 between its engaging position and its disengaging position. The electromechanical driver 460 is another form of linear actuator that may be utilized in certain embodiments, and is provided in the form of a stepping linear actuator. More particularly, the body portion 462 is provided as a stepper motor 463 that linearly drives the shaft 464 upon receiving an actuating signal in the form of a series of electrical pulses. The coupler 466 includes an opening 467 into which the post 457 of the engagement member 450 extends such that the coupler 466 is pivotably coupled with the engagement member 450. The coupler 466 is also coupled with the shaft 464 such that linear movement of the shaft 464 pivots the engagement member 450 between its engaging position and its disengaging position. The driver 460 may be in communication with the control assembly 150 and/or the external device 190 such that operation of the driver 460 can be controlled by the control assembly 150 and/or the external device 190.

The roller bearings 441 are seated in the depressions 445 of the retention plate 442, and have radially outward positions in which the roller bearings 441 are received in the tapered recesses 424 defined within the chamber 423. The tapered recesses 424 and the retainer depressions 445 are configured to urge the roller bearings 441 from the radially outward positions thereof toward radially inward positions thereof in response to relative rotation of the arms 410, 420 about the pivot axis 402. Relative rotation of the arms 410, 420 also causes the roller bearings 441 to urge the retention plate 442 downward against the biasing force of the override spring mechanism 449.

Figure 14:
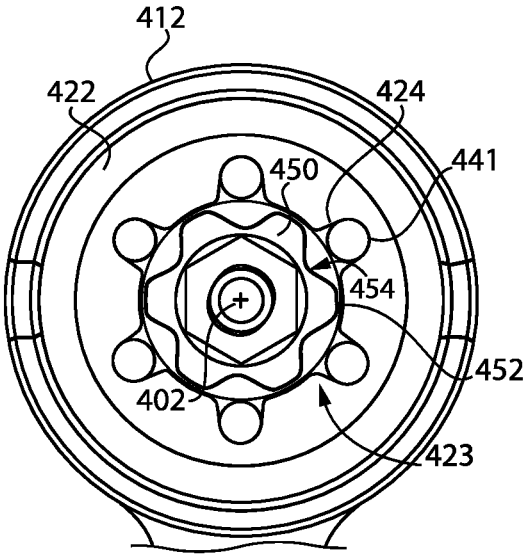
FIG. 14 is a cutaway plan view of a portion of the armature assembly illustrated in FIG. 11 while in a releasing state.

When the hold-open mechanism 430 is in its releasing state, the engagement member 450 is in its disengaging position (FIG. 14). In this state, the recesses 454 are aligned with the tapered recesses 424 and permit radially-inward movement of the roller bearings 441, thereby permitting relative rotation of the arms 410, 420 about the pivot axis 402. As with the above-described hold-open mechanisms 230, 330, the torque required to cause such relative rotation of the arms 410, 420 when the hold-open mechanism 430 is in its releasing state is relatively low, such as below a threshold value corresponding to the torque the closer body 110 is capable of supplying as the closer body 110 urges the door 94 toward its closed position. Thus, when the hold-open mechanism 430 is in its releasing state, the resistive torque generated by the armature assembly 400 is relatively low, and the forces generated by the closer body 110 are sufficient to drive the door 94 toward its closed position.

Figure 15:
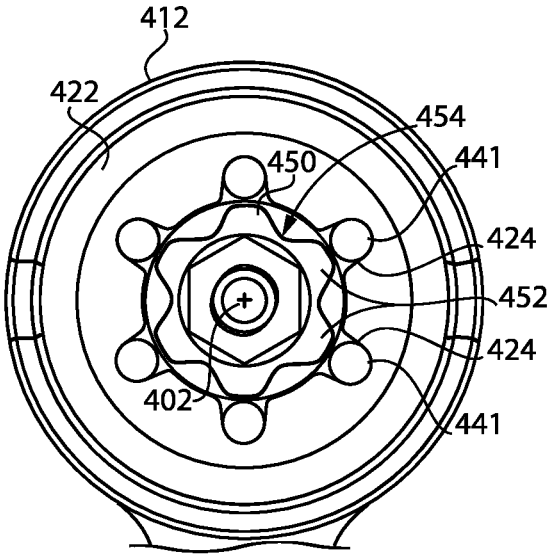
FIG. 15 is a cutaway plan view of a portion of the armature assembly illustrated in FIG. 11 while in a holding state.
Figure 16:
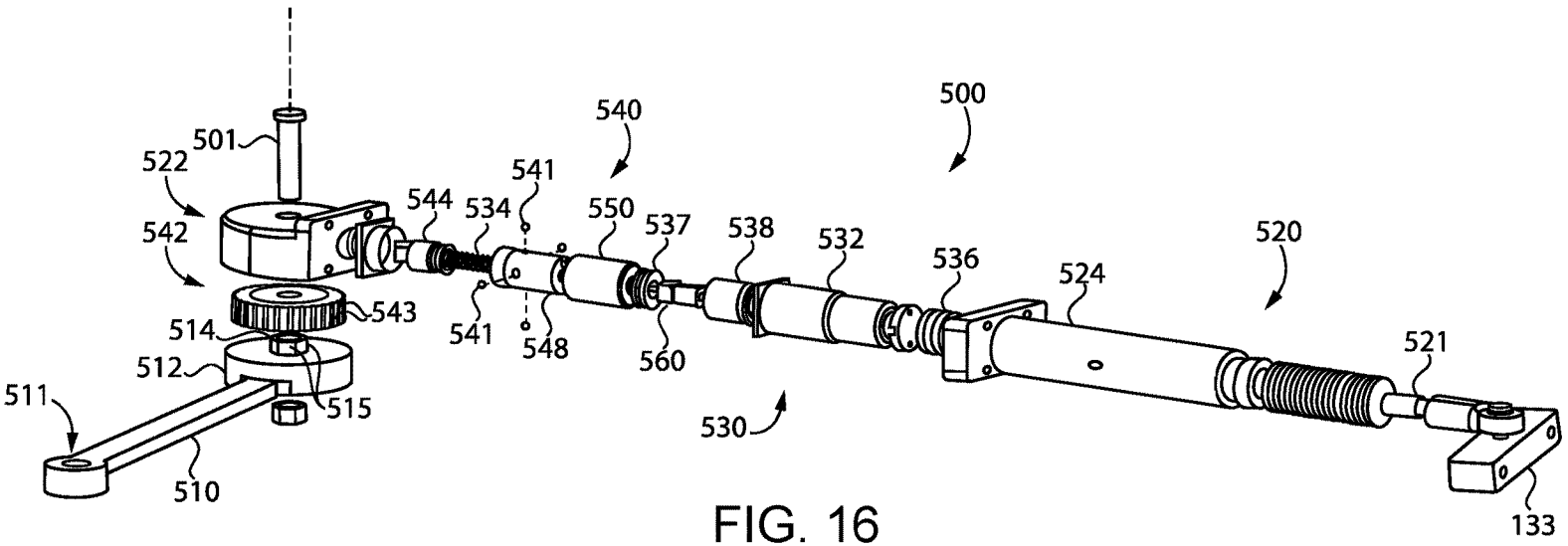
FIG. 16 is an exploded assembly view of an armature assembly according to certain embodiments.
Figure 17:
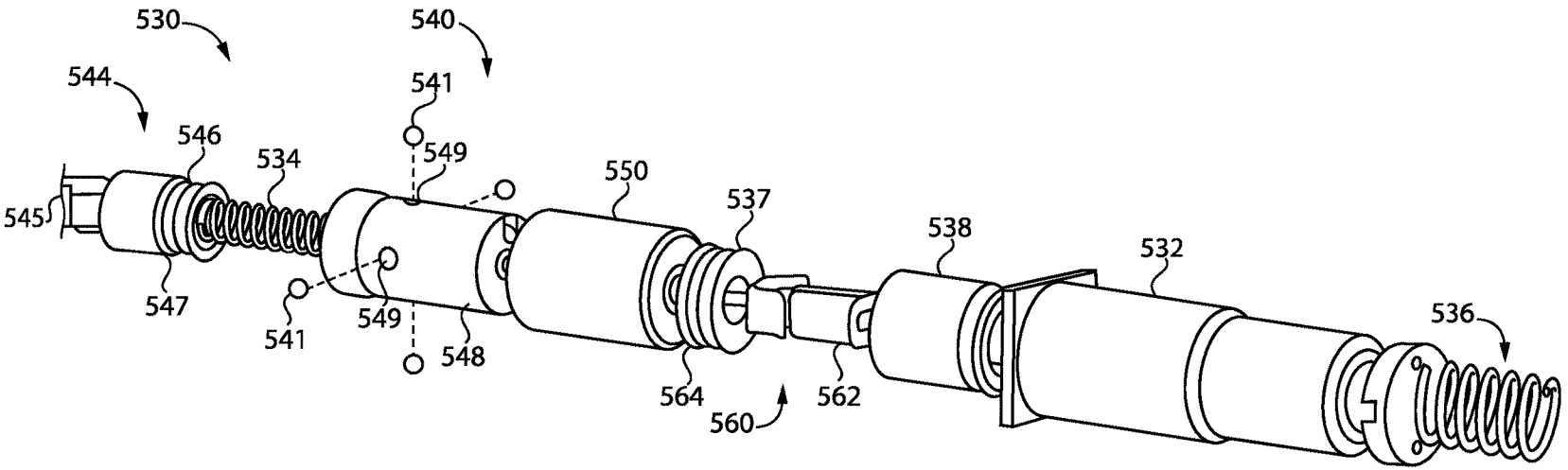
FIG. 17 is an exploded assembly view of a portion of the armature assembly illustrated in FIG. 16.
Figure 18:
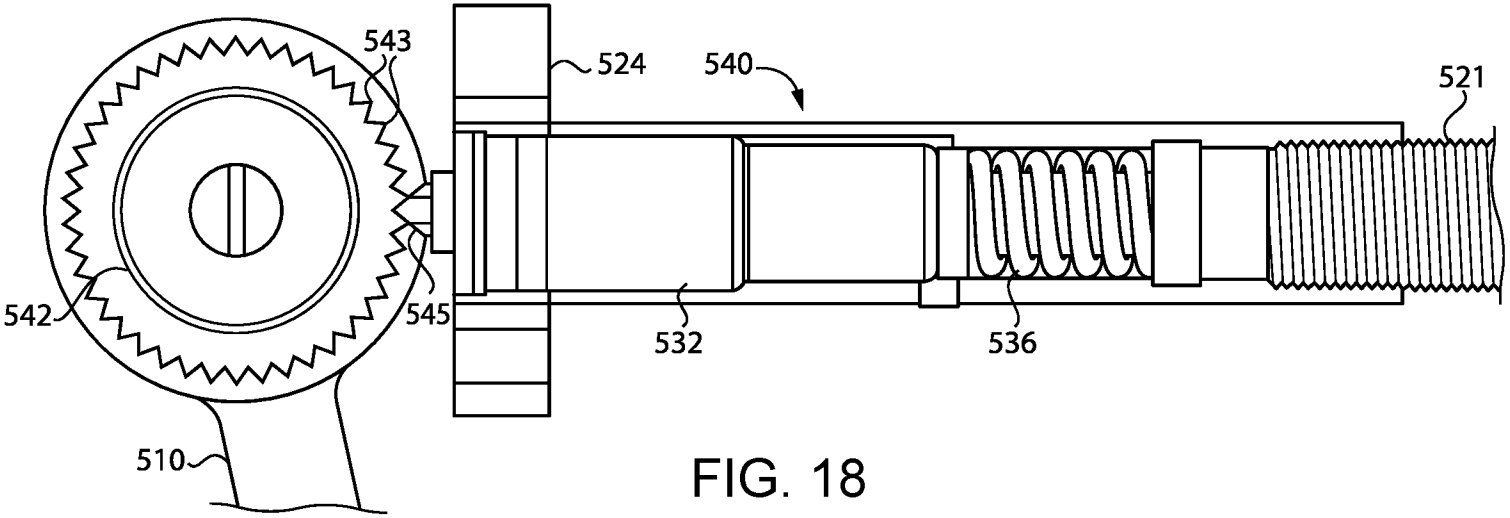
FIG. 18 is a plan view of a portion of the armature assembly illustrated in FIG. 16.
Figure 19:
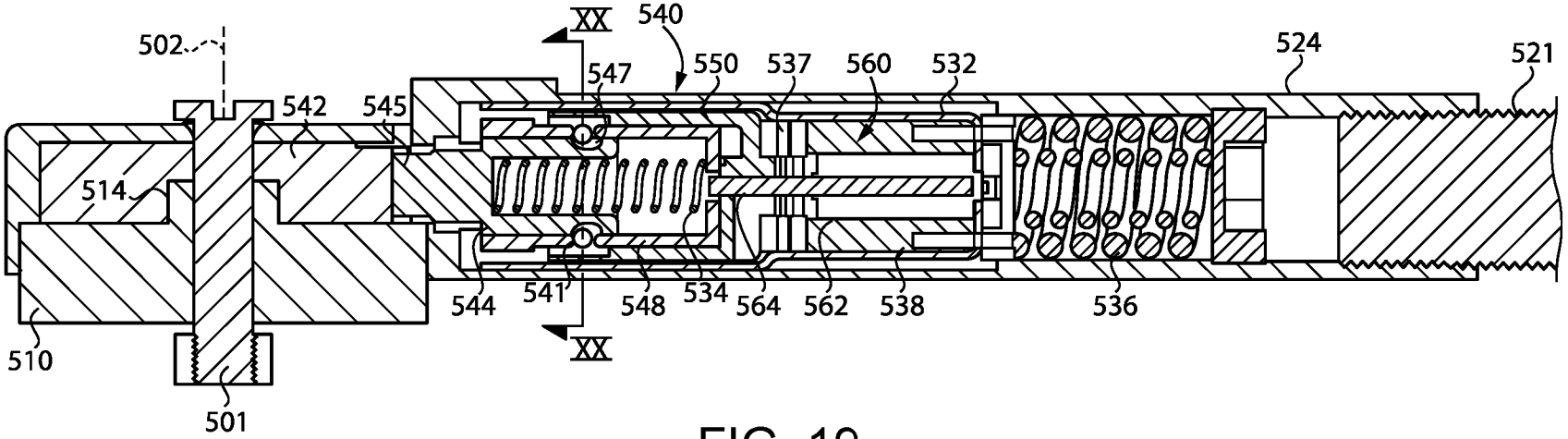
FIG. 19 is a cross-sectional view of a portion of the armature assembly illustrated in FIG. 16.

When the hold-open mechanism 430 is in its holding state, the engagement member 450 is in its engaging position (FIG. 15). In this state, the projections 452 are aligned with the tapered recesses 424 such that radially-inward movement of the roller bearings 441 is blocked. Thus, in order for relative rotation of the arms 410, 420 to occur, the torque applied to the arms 410, 420 must be sufficient to drive the retention plate 442 to its lower position against the biasing force of the override spring mechanism 449. As with the above-described hold-open mechanisms 230, 330, the torque required to cause such relative rotation of the arms 410, 420 when the hold-open mechanism 430 is in its holding state is relatively high, such as above the threshold value that the closer body 110 is capable of imparting as the closer body 110 urges the door 94 toward its closed position. Thus, when the hold-open mechanism 430 is in its holding state, the resistive torque generated by the armature assembly 400 is relatively high, and the forces generated by the closer body 110 are insufficient to drive the door 94 toward its closed position. This defines the held condition of the closure assembly 90, in which the door 94 is held in the last position to which it was moved.

Operation of the armature assembly 400 is somewhat similar to the operation of the armature assemblies 200, 300 in that the hold-open mechanism 430 selectively prevents relative rotation of the arms 410, 420 by selectively rotationally coupling the retention plate 432 with the second arm 420. During opening of the door 94, the electromechanical driver 460 maintains the engagement member 450 in its disengaging position. As a result, the relatively low resistive torque provided by the hold-open mechanism 430 does not appreciably interfere with opening of the door 94.

Upon release of the door 94 (or satisfaction of one or more additional or alternative criteria such as those described herein), the driver 460 is actuated. Actuation of the driver 460 may be based in part upon information received from the sensor 140. For example, the control assembly 150 may actuate the driver 460 when the information from the sensor module 140 indicates that the door 94 has stalled in an open position, or has begun returning toward its closed position. Upon actuation of the driver 460, the driver 460 moves the engagement member 450 to its engaging position. As a result, the hold-open mechanism 430 releasably rotationally couples the retention plate 442 with the second arm 420 by generating the resistive torque, thereby selectively preventing relative pivoting of the arms 410, 420 in the closing direction. Due to the fact that the threshold torque required to cause relative pivoting of the arms 410, 420 is beyond the threshold limit that is capable of being supplied by the closer body 110, the door 94 is maintained in the last position to which it was moved.

As with the armature assemblies 200, 300, the hold-open mechanism 430 of the armature assembly 400 is configured to transition from the holding state to the releasing state in response to a sufficient force being exerted on the door 94. For example, should a user exert on the door 94 a pushing force or pulling force sufficient to provide the threshold torque between the first and second arms 410, 420, the roller bearings 441 will urge the retention plate 442 to its lower or rearward position against the force of the override spring mechanism 449, thereby causing each roller bearing 441 to shift to the next depression 445. This shifting enables a slight rotation of the pinion 120, which may be detected by the sensor module 140. In response to detecting such rotation, the control assembly 150 may actuate the driver 460 to move the engagement member 450 to its disengaging position. With the engagement member 450 in its disengaging position, the torque required to continue relative rotation of the arms 410, 420 once again falls below the threshold value that the closer 100 is capable of generating. As a result, the door 94 is free to move to its closed position under the biasing force generated by the closer body 110. When the door 94 returns to its home position, the control assembly 150 may reset in preparation for the next open/close cycle.

With additional reference to FIGS. 16-19, illustrated therein is an armature assembly 500 according to certain embodiments. The armature assembly 500 may, for example, be utilized as the armature assembly 130 of the door closer 100. The armature assembly 500 generally includes a first arm 510, a second arm 520 pivotably attached to the first arm 510 via a pivot pin 501 defining a pivot axis 502, and an electromechanical hold-open mechanism 530 configured to selectively prevent relative pivoting of the first arm 510 and the second arm 520. As described herein, the hold-open mechanism 530 generally includes a clutch 540 including an engagement member 550, and further includes an electromechanical driver 560 operable to transition the clutch 540 between a holding state and a releasing state.

The first arm 510 includes a first end portion 511 configured for coupling with the pinion 120 and an opposite second end portion 512 engaged with the pivot pin 501. The second end portion 512 defines a post 514 that rotationally couples with a gear 542 of the clutch 540. For example, the post 514 may have a geometry that matingly engages a recess formed in the gear 542, such as a geometry including one or more flats 515. The pivot pin 501 extends through an opening in the post 516 such that the second end portion 512 is operable to rotate or pivot about the pivot axis 502.

The second arm 520 includes a first end portion 521 pivotably coupled with the shoe 138, an opposite second end portion 522 mounted for rotation about the pivot pin 501, and a tubular body 524 extending between and connecting the first end portion 521 and the second end portion 522. The body 524 defines a chamber in which at least a portion of the hold-open mechanism 530 is seated, and may be threadedly engaged with the first end portion 521 to facilitate adjustment of the effective length of the second arm 520.

As noted above, the hold-open mechanism 530 generally includes a clutch 540 including an engagement member 550, and further includes an electromechanical driver 560 operable to transition the clutch 540 between a holding state and a releasing state. The hold-open mechanism 530 further includes a housing 532 in which at least a portion of the clutch 540 is seated, a relatively light primary biasing member 534 urging a plunger 544 of the clutch 540 toward a projected position, and a relatively heavy override spring mechanism 536 urging a portion of the clutch 540 toward an engaging position. In the illustrated form, each of the biasing member 534 and the override spring mechanism 536 is provided in the form of a compression spring. It is also contemplated that the primary biasing member 534 and/or the override spring mechanism 536 may take another form, such as one involving an extension spring, a torsion spring, a leaf spring, an elastic member, and/or one or more magnets. The hold-open mechanism 530 may further include a motor housing 538 seated in the housing 532 and/or a thrust bearing 537 engaged between the engagement member 550 and the motor housing 538. As described herein, the hold-open mechanism 530 is configured to selectively prevent relative pivoting of the arms 510, 520 about the pivot axis 502 by generating a resistive torque.

The clutch 540 includes the engagement member 550, and further includes a plurality of roller bearings 541, a transmission component in the form of a gear 542 having tapered teeth 543, a plunger 544 including a tapered nose 545 that engages the tapered teeth 543, and a bearing cage 548 in which the plunger 544 is slidably seated. The plunger 544 further includes an annular channel 546 that is defined in part by a ramp 547 leading to a radially outer surface of the plunger 544. The bearing cage 548 includes a plurality of apertures 549, and the roller bearings 541 are seated in the annular channel 546 and extend into the apertures 549. The biasing member 534 is engaged between the plunger 544 and the bearing cage 548, and biases the plunger 544 toward a forward or projected position in which the tapered nose 545 engages the tapered teeth 543.

Figure 21:
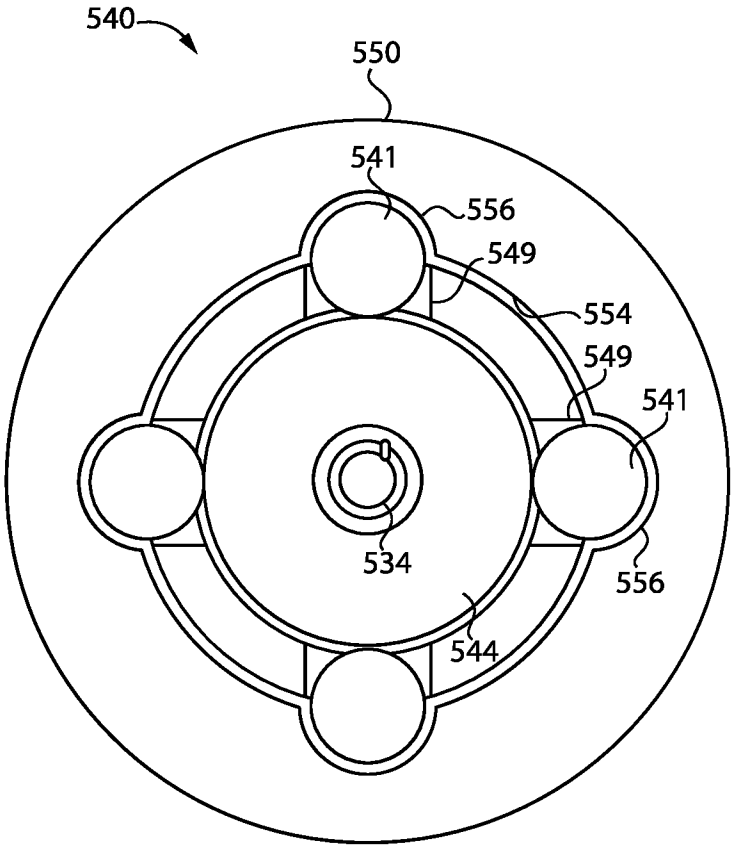
FIG. 21 is a cross-sectional view taken along the line XX-XX of FIG. 19, and illustrates a portion of the armature assembly while the armature assembly is in a releasing state.
Figure 20:
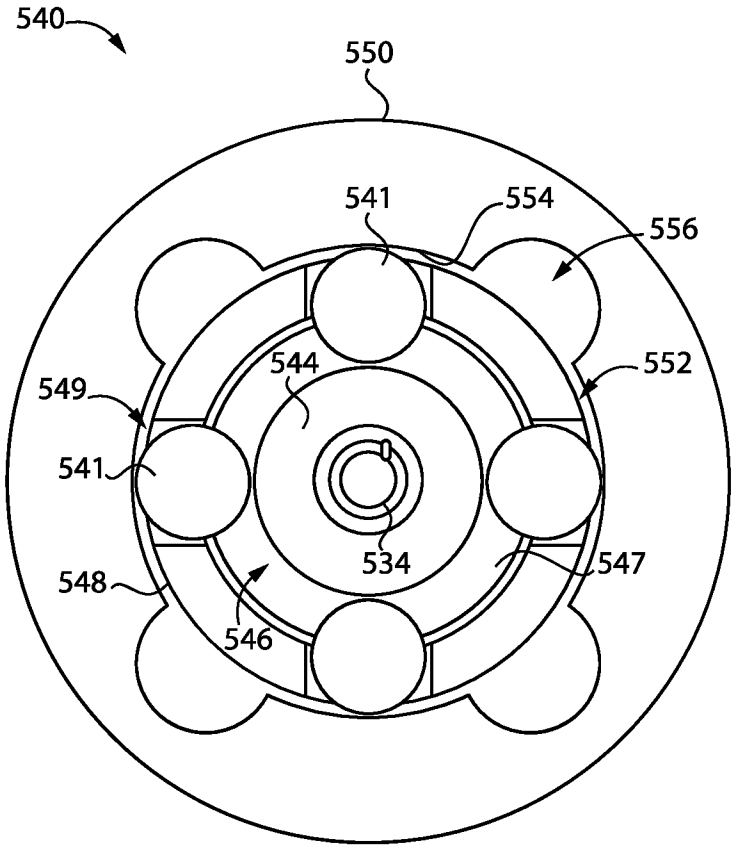
FIG. 20 is a cross-sectional view taken along the line XX-XX of FIG. 19, and illustrates a portion of the armature assembly while the armature assembly is in a holding state.

With additional reference to FIGS. 20 and 21, the engagement member 550 defines a chamber 552 in which various components of the clutch 540 are seated. The chamber 552 is defined in part by a blocking surface 554 and in part by a plurality of recesses 556. The engagement member 550 is rotatable between an engaging position and a disengaging position. In the engaging position (FIG. 20), the blocking surface 554 is aligned with the apertures 549 and prevents radially outward movement of the roller bearings 541. In the disengaging position (FIG. 21), the recesses 556 are aligned with the apertures 549 and permit limited radially outward movement of the roller bearings 541. As described herein, the blocking/unblocking position of the engagement member 550 corresponds to the holding/releasing state of the hold-open mechanism 530.

The electromechanical driver 560 is operable to rotate the engagement member 550 between its engaging position and its disengaging position, and generally includes a body 562 and a shaft 564 engaged with the body 562 such that the body 562 is operable to rotate the shaft 564. In the illustrated form, the body 562 is provided as a rotary motor, while in other embodiments, the body 562 may be provided as a rotary solenoid. The driver 560 may be in communication with the control assembly 150 and/or the external device 190 such that the control assembly 150 and/or the external device 190 is operable to control operation of the electromechanical driver 560.

The roller bearings 541 are seated in the apertures 549 of the bearing cage 548, and are further seated in the annular channel 546 when the plunger 544 is in its projected position. When a torque is exerted on the gear 542, engagement between the tapered teeth 543 and the tapered nose 545 urge the plunger 544 rearward toward a depressed position. Such depression of the plunger 544 causes the ramp 547 to urge the bearings 541 from their radially inward positions to their radially outward positions, and such radially outward movement of the bearings 541 is selectively prevented by the engagement member 550. In such a case, the force required to move the plunger 544 rearward no longer corresponds to the relatively light biasing force provided by the biasing member 534, but instead corresponds to the relatively heavier biasing force provided by the override spring mechanism 536 such that the resistive torque is increased. More particularly, due to the fact that the plunger 544 is longitudinally coupled with the bearing cage 548 by the bearings 541, the depressing force generated by engagement between the teeth 543 and the nose 545 is transmitted to the housing 532 via the engagement member 550 and the motor housing 538. The thrust bearing 537 may isolate the driver 560 from these forces. When the torque applied to the gear 542 reaches a threshold value, the entire hold-open mechanism 530 shifts rearward against the force of the override spring mechanism 536.

When the hold-open mechanism 530 is in its releasing state, the engagement member 550 is in its disengaging position (FIG. 21). In this state, the recesses 556 are aligned with the apertures 549 and permit radially outward movement of the roller bearings 541. As a result, the plunger 544 is capable of being depressed against the lighter biasing force of the biasing member 534, thereby permitting relative rotation of the arms 510, 520 about the pivot axis 502. As with the above-described hold-open mechanisms 230, 330, 430 the torque required to cause such relative rotation of the arms 510, 520 when the hold-open mechanism 530 is in its releasing state is relatively low, such as below a threshold value corresponding to the torque the closer body 110 is capable supplying as the closer body 110 urges the door 94 toward its closed position. Thus, when the hold-open mechanism 530 is in its releasing state, the forces generated by the closer body 110 are sufficient to drive the door 94 toward its closed position.

When the hold-open mechanism 530 is in its holding state, the engagement member 550 is in its engaging position (FIG. 20). In this state, the blocking surface 554 is aligned with the apertures 549 such that radially outward movement of the roller bearings 541 is blocked. Thus, in order for relative rotation of the arms 510, 520 to occur, the torque applied to the arms 510, 520 must be sufficient to drive the hold-open mechanism 530 to its rearward position against the relatively heavier biasing force of the override spring mechanism 536. As with the above-described hold-open mechanisms 230, 330, 430, the torque required to cause such relative rotation of the arms 510, 520 when the hold-open mechanism 530 is in its holding state is relatively high, such as above the threshold value that the closer 100 is capable of imparting as the closer 100 urges the door 94 toward its closed position. Thus, when the hold-open mechanism 530 is in its holding state, the forces generated by the closer 100 are insufficient to drive the door 94 toward its closed position. This defines the held condition of the closure assembly 90, in which the door 94 is held in the last position to which it was opened.

Operation of the armature assembly 500 is somewhat similar to the operation of the armature assemblies 200, 300, 400, in that the hold-open mechanism 530 selectively prevents relative rotation of the arms 510, 520 by selectively rotationally coupling the gear 542 with the second arm 520. During opening of the door 94, the electromechanical driver 560 maintains the engagement member 550 in its disengaging position. As a result, the relatively low resistive torque provided by the hold-open mechanism 530 does not appreciably interfere with opening of the door 94.

Upon release of the door 94 (and/or satisfaction of additional or alternative criteria such as those described herein), the driver 560 is actuated. Actuation of the driver 560 may be based in part upon information received from the sensor module 140. For example, the control assembly 150 may actuate the driver 560 when the information from the sensor module 140 indicates that the door 94 has stalled in an open position, or has begun returning toward its closed position. Upon actuation of the driver 560, the driver 560 moves the engagement member 550 to its engaging position (FIG. 20). As a result, the hold-open mechanism 530 releasably rotationally couples the gear 542 with the second arm 520 by generating resistive torque, thereby selectively preventing relative pivoting of the arms 510, 520 in the closing direction. Due to the fact that the threshold torque required to cause relative pivoting of the arms 510, 520 is beyond the threshold limit that is capable of being supplied by the closer body 110, the hold-open mechanism 530 maintains the door 94 in the last position to which it was moved.

As with the armature assemblies 200, 300, 400, the hold-open mechanism 530 of the armature assembly 500 is configured to transition from the holding state to the releasing state in response to a sufficient force being exerted on the door 94. For example, should a user exert on the door 94 a pushing force or pulling force sufficient to provide the threshold torque between the first and second arms 510, 520, the engagement between the teeth 543 and the nose 545 urges the entire hold-open mechanism 530 rearward against the force of the override spring mechanism 536. This shifting enables a slight rotation of the pinion 120, which rotation may be detected by the sensor 142. In response to detecting such rotation, the control assembly 150 may actuate the driver 560 to move the engagement member 550 to its disengaging position. With the engagement member 550 in its disengaging position, the torque required to continue relative rotation of the arms 510, 520 once again falls below the threshold value that the closer body 110 is capable of generating. As a result, the door 94 is free to move to its closed position under the biasing force generated by the closer body 110. When the door 94 returns to its home position, the control assembly 150 may reset in preparation for the next open/close cycle.

Figure 22:
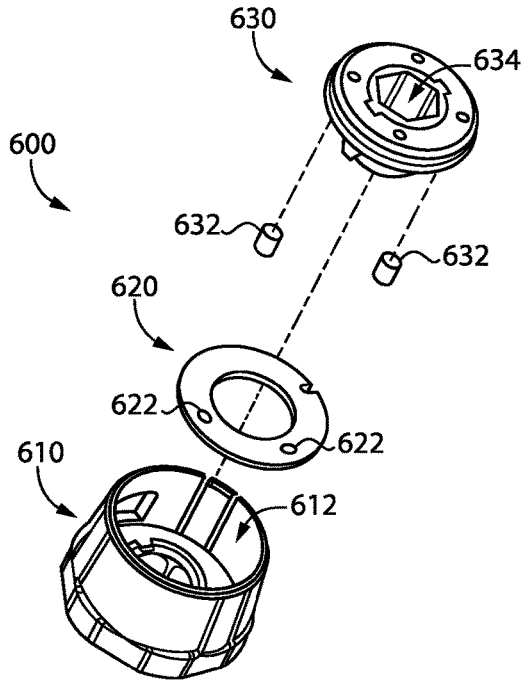
FIG. 22 is an exploded assembly view of a sensor module according to certain embodiments.
Figure 23:
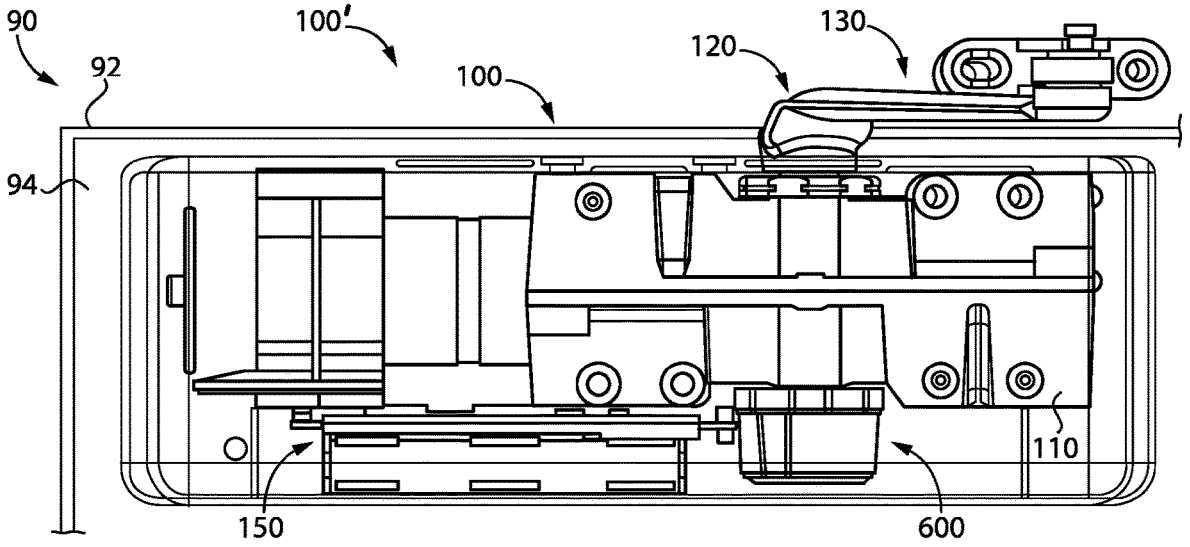
FIG. 23 is an elevational view of the closer assembly illustrated in FIG. 1.

With additional reference to FIGS. 22 and 23, illustrated therein is a sensor module 600 according to certain embodiments, and a door closer assembly 100' including the door closer 100 and the sensor module 600 as the sensor module 140. In certain embodiments, the sensor module 600 may be provided as a standalone module configured for use with the door closer 100. In other embodiments, the sensor module 600 may be provided in a kit configured for use with the closer 100, and such a kit may further include the armature assembly 130. In further embodiments, the door closer 100 and the armature assembly 130 may be sold as a system, and such a system may further include the sensor module 600.

The sensor module 600 generally includes a housing 610, a printed circuit board (PCB) 620 mounted in the housing 610, and a cap 630 rotatably mounted to the housing 610. The housing 610 is configured for mounting to the closer body 110, and defines a chamber 612 in which the PCB 620 is seated. The PCB 620 includes at least one Hall effect sensor 622, and in the illustrated form includes two Hall effect sensors 622. The cap 630 includes at least one magnet 632, and in the illustrated form includes two magnets 632. The cap 630 is configured for rotational coupling with the pinion 120, and in the illustrated form includes a central opening 624 having a geometry corresponding to that of the pinion 120.

The PCB 620 may be in communication with the control assembly 150 and/or the external device 190 such that the controller 152 and/or the external device 190 is operable to receive information from the Hall effect sensors 622. Due to the fact that the magnets 632 move with the pinion 120 while the Hall effect sensors 622 remain stationary relative to the closer body 110, the rotational position of the pinion 120 can be determined from the information generated by the sensors 622. From the information relating to the position of the pinion 120, the controller 152 may derive related information, such as the angular position of the door 94 and/or the angular velocity and/or angular acceleration of the door 94 and/or the pinion 120. As described herein, such information may be utilized in controlling the operation of the hold-open mechanism 133 and/or may be used for various analytical purposes.

With the sensor module 600 providing information relating to the position, velocity, and/or acceleration of the pinion 120 and/or the door 94, such information may be utilized in any of a number of ways. For example, this information may be utilized to understand the active status of the door as well as provide insight into actions that may need to be taken, such as adjustment of the closing speed of the door 94 and/or routine maintenance. In certain embodiments, the information may be shared with an external device 190 such that a facility manager has access to the information and can take the needed actions. In certain embodiments, the information is shared with other accessories of the door closer assembly 100' (e.g., the hold-open mechanism 133 or a power boost module) to facilitate operation of such accessories.

Positional information can also be utilized in trending analyses, for example by providing information relating to the number of open/close cycles the closure assembly 90 has undergone, the days and/or times of highest volume usage, and/or the typical opening angle. The positional information may additionally or alternatively be used to provide an exception notification, such as a notification provided when the door 94 is opened to too wide an angle, a notification provided when the door 94 is propped open, or a notification when tailgating may be present (e.g., when the door 94 does not return to its fully closed position and no additional information is received from a credential reader and/or a request to exit switch).

Door speed information may, for example, be utilized in combination with an installation tool to identify which valves and/or springs need to be adjusted by the installer. Door speed information may additionally or alternatively be utilized to provide exception notifications, such as a notification that the door 94 is closing too fast or too slow. Door speed information may additionally or alternatively be utilized in trending analyses, for example to determine whether the average door speed is increasing or decreasing, which may indicate that preventive maintenance is warranted.

Door acceleration information can likewise be utilized in any of a number of manners. For example, door acceleration information may be utilized to generate exception notifications, such as a notification relating to impact or slamming of the door 94. Door acceleration information may additionally or alternatively be utilized in trending analyses, for example to determine how the door 94 is typically opened.

When a sensor module 140 such as the sensor module 600 is provided in combination with an armature assembly 130 such as those described above, the information provided by the sensor module 140/600 may be utilized by the control assembly 150 to control operation of the hold-open mechanism 133. For example, when a user holds the door 94 in an open position for a predetermined period of time, the control assembly 150 may detect a stall in the movement of the door 94. As noted above, such a stall condition may cause the control assembly 150 to operate the driver 136 to transition the hold-open mechanism 133 to its holding state.

As another example, if the information from the sensor module 140/600 indicates that the door 94 has opened and closed several times in rapid succession, the control assembly 150 may operate the driver 136 to maintain the hold-open mechanism 133 in its holding state for a predetermined time, and subsequently operate the driver 136 to transition the hold-open mechanism 133 to its releasing state.

Information received from a sensor module 140/600 may additionally or alternatively be utilized to provide a lock-down delay function. When the access control system 192 goes into lockdown mode (e.g., in response to an emergency condition such as a dangerous individual on the premises) and the door 94 is open, the hold-open mechanism 133 may transition from its holding state to its releasing state in order to facilitate closing of the door 94. When the door 94 reaches its closed position, the hold-open mechanism 133 may enter its holding state in an attempt to maintain the door 94 in its closed position. In such forms, detecting motion of the door 94 would not necessarily cause the hold-open mechanism 133 to return to its releasing state, such that the high forces for mechanical override would be required at every point to open the door 94. While such a lockdown delay function would not necessarily prevent entry of the dangerous individual, it will delay such entry, which may buy the occupants additional time to escape to safety.

While an example Hall effect sensor module 600 has been illustrated as being included in the door closer assembly 100', it is also contemplated that the sensor module 600 may take another form. For example, the sensor module 600 may instead include a potentiometer or an optical encoder. However, potentiometers typically have relatively short lifespans, due to the wear and tear imparted to the wipers of the potentiometer during normal use. Additionally, optical encoders require a constant power supply, as a power loss will cause the controller to reset the counter used to determine the position of the door. As a result, systems utilizing optical encoders typically need recalibration after every power failure event. In light of these drawbacks, the illustrated embodiment of the sensor module 600 may provide one or more advantages over the alternative embodiments. For example, in contrast to potentiometers, the Hall effect sensor module 600 is contactless, which may increase the effective lifespan of the module 600. The Hall effect sensor module 600 requires relatively little power, and unlike optical encoders, does not require recalibration after a power failure event. Hall effect sensors 622 also provide relatively high speed operation, with over 100 kHz possible, and provide logic-compatible input and output. Additionally, the sensor module 600 has a broad temperature range and highly repeatable operation. Furthermore, magnetic sensors are typically relatively insensitive to contaminants (e.g., dust, dirt, liquids, and grease), as well as to shocks and vibrations.

Figure 24:
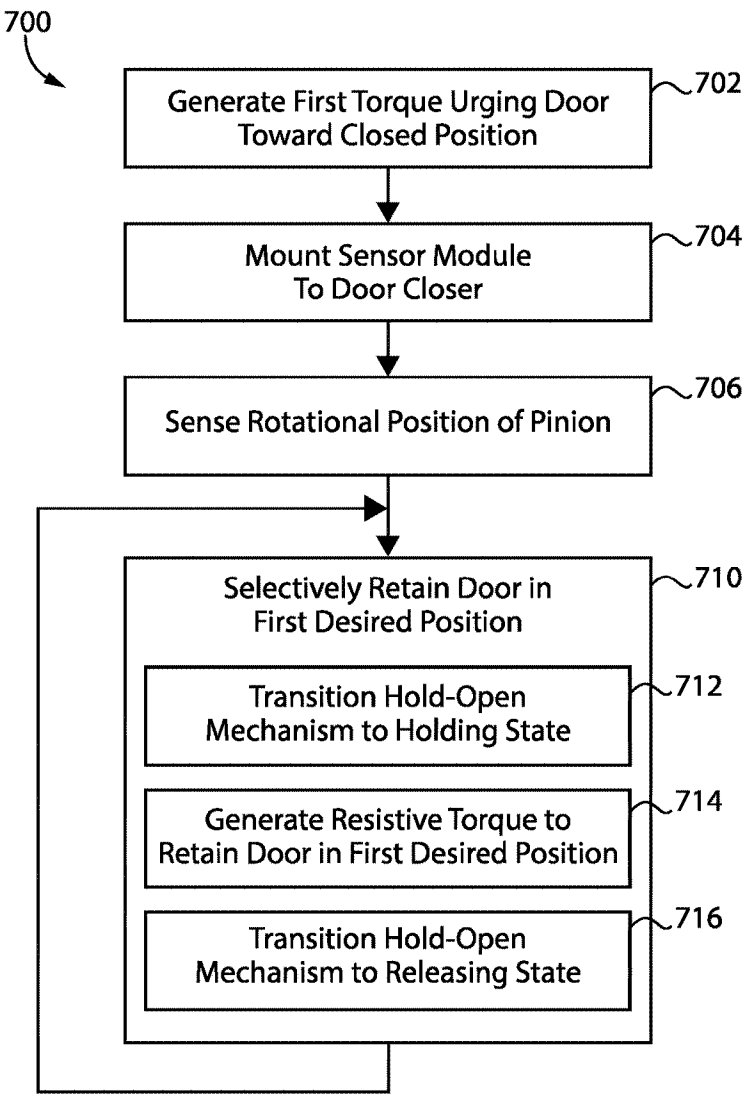
FIG. 24 is a schematic flow diagram of a process according to certain embodiments.

With additional reference to FIG. 24, an exemplary process 700 that may be performed using the closer assembly 100' is illustrated. Blocks illustrated for the processes in the present application are understood to be examples only, and blocks may be combined or divided, and added or removed, as well as re-ordered in whole or in part, unless explicitly stated to the contrary. Unless specified to the contrary, it is contemplated that certain blocks performed in the process 700 may be performed wholly by the control assembly 150 or the external device 190, or that the blocks may be distributed among one or more of the elements and/or additional devices or systems that are not specifically illustrated in FIGS. 1 and 2. Additionally, while the blocks are illustrated in a relatively serial fashion, it is to be understood that two or more of the blocks may be performed concurrently or in parallel with one another.

In certain embodiments, the process 700 may be performed using a closure assembly 90 including a doorframe 92, a door 94 mounted to the doorframe 92 for movement between a closed position and a plurality of open positions, and a door closer assembly 100' urging the door toward the closed position. The door closer assembly 100' generally includes a door closer 100 and an armature assembly 130, and may further include a sensor module 140 such as the sensor module 600. The door closer 100 includes a closer body 110 mounted to one of the door 94 or the doorframe 92 and a pinion 120 rotatably mounted to the closer body 110, and the armature assembly 130 is connected between the pinion 120 and the other of the door 94 or the doorframe 92. The armature assembly 130 generally includes a first arm 131 rotationally coupled with the pinion 121, and a second arm 132 pivotably coupled to the other of the door 94 or the doorframe 92 and pivotably coupled with the first arm 131.

The process 700 may include block 702, which generally involves generating, by the door closer 100, a first torque urging the door 94 toward the closed position. For example, block 702 may involve generating forces that urge the pinion 120 to rotate in a door-closing direction. Such forces may be generated by hydraulic, mechanical, and/or electromechanical devices within the closer body 110. As noted above, such mechanisms are known in the art, and need not be described herein. As will be appreciated, such torque is transmitted between the pinion 120 and the structure to which the second arm 132 is coupled (e.g., the doorframe 92 or the door 94) by the armature assembly 130.

In certain embodiments, the process 700 may include block 704, which generally involves mounting a sensor module 140 to the door closer 100. For example, block 704 may involve mounting the sensor module 600 illustrated in FIGS. 22 and 23 to the door closer 100. In such forms, block 704 may include mounting a housing 610 of the sensor module 600 to the closer body 110, wherein the housing 610 has disposed therein a Hall effect sensor 622. Block 704 may further include mounting a cap 630 to the pinion 120, wherein a magnet 632 is mounted to the cap 630.

In certain embodiments, the process 700 may include block 706, which generally involves sensing the rotational position of the pinion 120. By way of example, block 706 may be performed utilizing the sensor module 600, which may have been installed in block 704.

The process 700 includes block 710, which generally involves operating a hold-open mechanism 133 of the armature assembly 130 to selectively retain the door 94 in a desired position. The desired position may be the closed position or any of the open positions. In certain embodiments, block 710 may be performed to selectively retain the door 94 in the desired position based upon one or more criteria.

In certain embodiments, block 710 may be performed to selectively retain the door 94 in the closed position, for example as described above with reference to the lockdown delay function. In such forms, the one or more criteria may involve receiving a lockdown signal from the access control system 192

In certain embodiments, block 710 may be performed to selectively retain the door 94 in an open position. In such forms, the one or more criteria may relate to the position of the door 94. In certain embodiments, block 710 may be performed in response to information from the sensor module 140 indicating that the door 94 has been opened and has begun to close again. In certain embodiments, block 710 may be performed in response to information from the sensor module 140 indicating that the door 94 has been opened to at least a threshold angle. In certain embodiments, block 710 may be performed in response to information from the sensor module 140 indicating that the door 94 has been stalled in an open position for a predetermined period of time. In certain embodiments, block 710 may be performed in response to the information from the sensor module 140 indicating that the door 94 has undergone a predetermined number of directional changes within a predetermined period of time. In certain forms, block 710 may be performed based at least in part upon one or more schedules. For example, block 710 may be performed upon each opening of the door 94 that occurs within a timeframe specified by the schedule.

In addition or as an alternative to the position of the door 94, the one or more criteria may involve scheduling criteria such that the closure assembly 90 operates according to different operational profiles at different times and/or days. For example, one operational profile may be an "always propped" operational profile, in which block 710 is always performed when the door 94 is moved to its open position. Another example of an operational profile is a "never prop" operational profile, in which block 710 is not performed regardless of the information received from the sensor module 140. Another example of an operational profile is a "selectively prop" operational profile, in which block 710 is performed based upon one or more of the criteria related to the positional information received from the sensor module 140. Thus, certain embodiments of the process 700 may involve operating the closure assembly 90 according to a first operational profile during a first timeframe, and operating the closure assembly 90 according to a second operational profile during a second timeframe.

Block 710 includes block 712, which generally involves operating an electromechanical driver 136 of the hold-open mechanism 133 to transition the hold-open mechanism 133 from a releasing state to a holding state. Block 712 may, for example, involve moving the clutch 134 from its coupling state to its decoupling state, such as by moving the engagement member 135 from its disengaging position to its engaging position. In certain embodiments, block 712 may be performed while the door 94 is in its desired position. In other embodiments, block 712 may be performed prior to the door 94 reaching its desired position, and a ratchet mechanism may enable movement of the door 94 to its desired position.

Block 710 also includes block 714, which is performed with the hold-open mechanism in the holding state. Block 714 generally involves generating a resistive torque that retains the door 94 in the desired position against a first torque applied to the door 94. In certain embodiments, the first torque may be generated by the door closer 100, for example in block 702. In certain embodiments, generating the resistive torque may involve resisting movement of a movable component in a first direction with an override spring urging the movable component in a second direction opposite the first direction.

Block 710 may further include block 716, which is performed with the hold-open mechanism 133 in the holding state and based upon one or more release criteria. Block 716 generally involves transitioning the hold-open mechanism 133 to the releasing state, thereby reducing the resistive torque and permitting movement of the door 94 from the desired position. In certain embodiments, reducing the resistive torque comprises permitting movement of the movable component in the first direction without deforming the override spring. In certain embodiments, block 716 involves operating the driver 136 to return the clutch 134 to its decoupling position. In other embodiments, block 716 may involve activating a retention mechanism to selectively retain the clutch 134 in its decoupling position.

In certain forms, block 716 may involve releasing the door 94 from the desired position upon application of an override force to the door 94. In such forms, the release criterion may comprise the application to the door of a second torque greater than the first torque. Additionally or alternatively, the release criterion may comprise movement of the door 94 from the desired position, such as movement in response to application to the door of the second torque. As will be appreciated, such movement may be detected by the sensor module 140.

In certain forms, block 716 may involve releasing the door 94 from the desired position based upon release criterion relating to scheduling information. In certain forms, block 716 may involve releasing the door 94 from the desired position upon receiving a release command. The release command may, for example, be issued by an access control system 192. In certain embodiments, the release command may be transmitted from a remote location, such as one at least twenty feet from the closure assembly 90.

The process 700 may further include an additional iteration of block 710, which generally involves selectively holding the door 94 in a second desired position different from the first desired position. In certain embodiments, the first desired position may be an open position, and the second desired position may be a closed position. As noted above, the illustrated armature assembly 130 is capable of selectively retaining the door 94 in each of a plurality of open positions. Thus, in certain embodiments, the first desired position may be a first open position, and the second desired position may be a second open position different from the first open position. For example, the door 94 may define a first angle relative to the doorframe 92 in the first open position, and may define a second angle relative to the doorframe 92 when in the second open position, wherein the second angle different from the first angle. Further iterations of block 710 may be performed as desired to selectively retain the door 94 in additional desired positions.

In certain embodiments, the process 700 may be performed using the armature assembly 200 illustrated in FIGS. 3-7 as the armature assembly 130 of the closer assembly 100'. In such forms, block 712 may involve operating the driver 260 to move a movable engagement component in the form of the engagement pin 250 from its disengaging position to its engaging position. In certain embodiments, block 712 may be performed prior to the door 94 reaching its desired position, as the ratchet mechanism permits free rotation of the arms 210, 220 in the door-opening direction.

In block 714, the engagement between the teeth 246 and the tapered nose 255 causes the first torque generated in block 702 to be translated to a first force urging the engagement pin 250 rearward. This rearward movement is resisted by the override spring mechanism 258 such that a resistive torque corresponding to the stiffness of the override spring mechanism 258 is generated by the hold-open mechanism 230. Due to the fact that the resistive torque generated by the hold-open mechanism 230 is greater than the threshold value that the closer 100 is capable of generating, the resistive torque retains the door 94 in the last position to which it was opened.

In block 716, the hold-open mechanism 230 transitions to its releasing state in response to a release condition. For example, in embodiments in which the release condition is provided electronically (e.g., based upon scheduling criteria and/or release commands received from the access control system 192), block 716 may involve operating the driver 260 to drive the engagement pin 250 from its engaging position to its disengaging position. In embodiments in which the release condition is provided mechanically (e.g., by an applied torque exceeding the threshold torque and moving the door 94 away from its desired position), block 716 may involve transitioning the release mechanism 270 to its retaining state in which the releasing pin 272 retains the engagement pin 250 in its retracted position against the urging of the override spring mechanism 258.

In certain embodiments, the process 700 may be performed using the armature assembly 300 illustrated in FIGS. 8-10 as the armature assembly 130 of the closer assembly 100'. In such forms, block 712 may involve operating the driver 360 to move a movable engagement component in the form of the engagement assembly 350 from its disengaging position to its engaging position. Block 712 may be performed based upon information received from the sensor module 140 in block 706, for example as described above.

In block 714, the engagement between the teeth 343 and the tapered nose 353 causes the first torque generated in block 702 to be translated to a first force urging the engagement assembly 350 rearward. While rearward movement of the housing 351 against the biasing member 332 is prevented by the driver 360, rearward movement of the pin mechanism 352 is merely resisted by the override spring mechanism 354. As a result, a resistive torque corresponding to the stiffness of the override spring mechanism 354 is generated by the hold-open mechanism 330. Due to the fact that the resistive torque generated by the hold-open mechanism 330 is greater than the threshold value that the closer 100 is capable of generating, the resistive torque retains the door 94 in the last position to which it was opened.

In block 716, the hold-open mechanism 330 transitions to its releasing state in response to a release condition. For example, block 716 may involve operating the driver 360 to release the engagement assembly 350 for rearward movement against the force of the lighter biasing mechanism 332. As a result, the resistive torque is reduced, for example to a level below the threshold value such that the door closer 100 is capable of returning the door 94 to its closed position.

In certain embodiments, the process 700 may be performed using the armature assembly 400 illustrated in FIGS. 11-15 as the armature assembly 130 of the closer assembly 100'. In such forms, block 712 may involve operating the driver 460 to move a movable engagement component in the form of the engagement member 450 from its disengaging position to its engaging position. Block 712 may be performed based upon information received from the sensor module 140 in block 706, for example as described above.

In block 714, the engagement between the bearings 441 and the retention plate 442 causes the first torque generated in block 702 to be translated to a first force urging a movable component in the form of the retention plate 442 rearward against the urging of the override spring mechanism 449. As a result, a resistive torque corresponding to the stiffness of the override spring mechanism 449 is generated by the hold-open mechanism 430. Due to the fact that the resistive torque generated by the hold-open mechanism 430 is greater than the threshold value that the closer 100 is capable of generating, the resistive torque retains the door 94 in the last position to which it was opened.

In block 716, the hold-open mechanism 430 transitions to its releasing state in response to a release condition. For example, block 716 may involve operating the driver 460 to move the engagement member 450 to its disengaging position, thereby reducing the resistive torque to a level below the threshold value such that the door closer 100 is capable of returning the door 94 to its closed position.

In certain embodiments, the process 700 may be performed using the armature assembly 500 illustrated in FIGS. 16-21 as the armature assembly 130 of the closer assembly 100'. In such forms, block 712 may involve operating the driver 560 to move a movable engagement component in the form of the engagement member 550 from its disengaging position to its engaging position. Block 712 may be performed based upon information received from the sensor module 140 in block 706, for example as described above.

In block 714, the engagement between the teeth 543 and the tapered nose 545 causes the first torque generated in block 702 to be translated to a first force urging a movable component in the form of the plunger 544 rearward. With movement of the plunger 544 relative to the housing 532 blocked by the engagement between the bearings 541 and the engagement member 550, the first force urges the housing 532 rearward against the urging of the override spring mechanism 536. As a result, a resistive torque corresponding to the stiffness of the override spring mechanism 536 is generated by the hold-open mechanism 530. Due to the fact that the resistive torque generated by the hold-open mechanism 530 is greater than the threshold value that the closer 100 is capable of generating, the resistive torque retains the door 94 in the last position to which it was opened.

In block 716, the hold-open mechanism 530 transitions to its releasing state in response to a release condition. For example, block 716 may involve operating the driver 560 to move the engagement member 550 to its disengaging position, thereby releasing the plunger 544 for rearward movement against the force of the biasing member 534. As a result, the resistive torque is reduced, for example to a level below the threshold value such that the door closer 100 is capable of returning the door 94 to its closed position.

Figure 25:
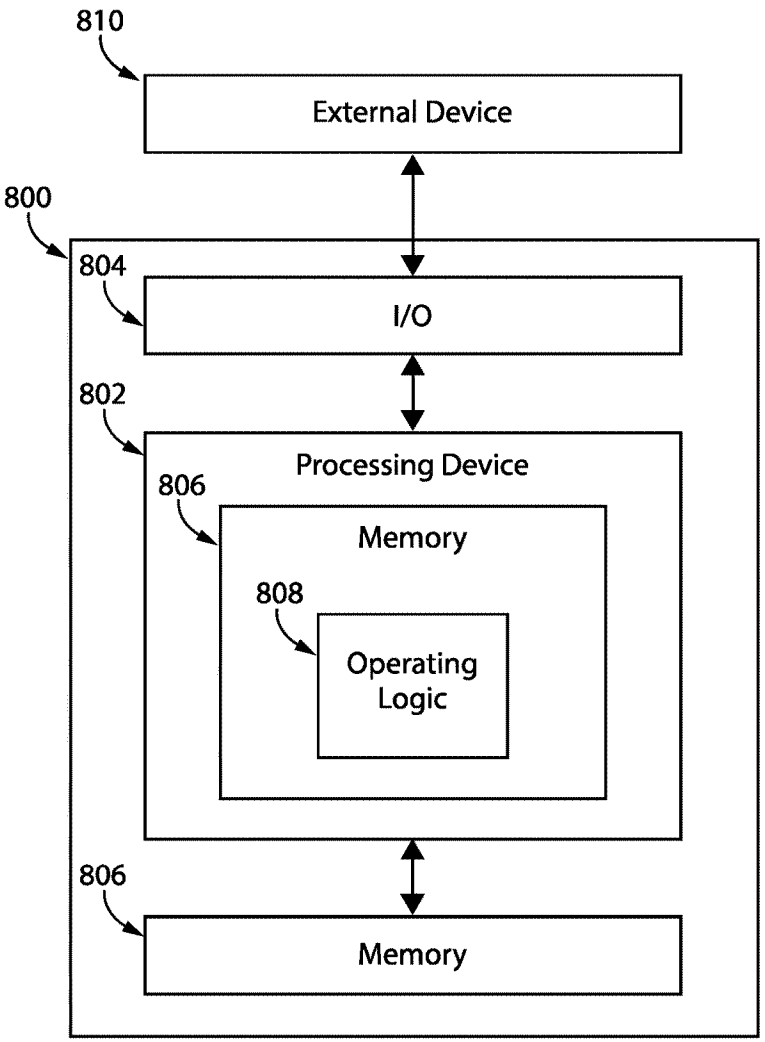
FIG. 25 is a schematic block diagram of a computing device that may be utilized in certain embodiments.

Referring now to FIG. 25, a simplified block diagram of at least one embodiment of a computing device 800 is shown. The illustrative computing device 800 depicts at least one embodiment of a controller or external device that may be utilized in connection with the controller 152 or external device 190 illustrated in FIG. 2.

Depending on the particular embodiment, the computing device 800 may be embodied as a server, desktop computer, laptop computer, tablet computer, notebook, netbook, Ultrabook™ mobile computing device, cellular phone, smartphone, wearable computing device, personal digital assistant, Internet of Things (IoT) device, reader device, access control device, control panel, processing system, router, gateway, and/or any other computing, processing, and/or communication device capable of performing the functions described herein.

The computing device 800 includes a processing device 802 that executes algorithms and/or processes data in accordance with operating logic 808, an input/output device 804 that enables communication between the computing device 800 and one or more external devices 810, and memory 806 which stores, for example, data received from the external device 810 via the input/output device 804.

The input/output device 804 allows the computing device 800 to communicate with the external device 810. For example, the input/output device 804 may include a transceiver, a network adapter, a network card, an interface, one or more communication ports (e.g., a USB port, serial port, parallel port, an analog port, a digital port, VGA, DVI, HDMI, FireWire, CAT 5, or any other type of communication port or interface), and/or other communication circuitry. Communication circuitry may be configured to use any one or more communication technologies (e.g., wireless or wired communications) and associated protocols (e.g., Ethernet, Bluetooth®, Bluetooth Low Energy (BLE), Wi-Fi®, WiMAX, etc.) to effect such communication depending on the particular computing device 800. The input/output device 804 may include hardware, software, and/or firmware suitable for performing the techniques described herein.

The external device 810 may be any type of device that allows data to be inputted or outputted from the computing device 800. For example, in various embodiments, the external device 810 may be embodied as the sensor 142, the controller 152, the electromechanical driver 136, or the external device 190. Further, in some embodiments, the external device 810 may be embodied as another computing device, switch, diagnostic tool, controller, printer, display, alarm, peripheral device (e.g., keyboard, mouse, touch screen display, etc.), and/or any other computing, processing, and/or communication device capable of performing the functions described herein. Furthermore, in some embodiments, it should be appreciated that the external device 810 may be integrated into the computing device 800.

The processing device 802 may be embodied as any type of processor(s) capable of performing the functions described herein. In particular, the processing device 802 may be embodied as one or more single or multi-core processors, microcontrollers, or other processor or processing/controlling circuits. For example, in some embodiments, the processing device 802 may include or be embodied as an arithmetic logic unit (ALU), central processing unit (CPU), digital signal processor (DSP), and/or another suitable processor(s). The processing device 802 may be a programmable type, a dedicated hardwired state machine, or a combination thereof. Processing devices 802 with multiple processing units may utilize distributed, pipelined, and/or parallel processing in various embodiments. Further, the processing device 802 may be dedicated to performance of just the operations described herein, or may be utilized in one or more additional applications. In the illustrative embodiment, the processing device 802 is of a programmable variety that executes algorithms and/or processes data in accordance with operating logic 808 as defined by programming instructions (such as software or firmware) stored in memory 806. Additionally or alternatively, the operating logic 808 for processing device 802 may be at least partially defined by hardwired logic or other hardware. Further, the processing device 802 may include one or more components of any type suitable to process the signals received from input/output device 804 or from other components or devices and to provide desired output signals. Such components may include digital circuitry, analog circuitry, or a combination thereof.

The memory 806 may be of one or more types of non-transitory computer-readable media, such as a solid-state memory, electromagnetic memory, optical memory, or a combination thereof. Furthermore, the memory 806 may be volatile and/or nonvolatile and, in some embodiments, some or all of the memory 806 may be of a portable variety, such as a disk, tape, memory stick, cartridge, and/or other suitable portable memory. In operation, the memory 806 may store various data and software used during operation of the computing device 800 such as operating systems, applications, programs, libraries, and drivers. It should be appreciated that the memory 806 may store data that is manipulated by the operating logic 808 of processing device 802, such as, for example, data representative of signals received from and/or sent to the input/output device 804 in addition to or in lieu of storing programming instructions defining operating logic 808. As illustrated, the memory 806 may be included with the processing device 802 and/or coupled to the processing device 802 depending on the particular embodiment. For example, in some embodiments, the processing device 802, the memory 806, and/or other components of the computing device 800 may form a portion of a system-on-a-chip (SoC) and be incorporated on a single integrated circuit chip.

In some embodiments, various components of the computing device 800 (e.g., the processing device 802 and the memory 806) may be communicatively coupled via an input/output subsystem, which may be embodied as circuitry and/or components to facilitate input/output operations with the processing device 802, the memory 806, and other components of the computing device 800. For example, the input/output subsystem may be embodied as, or otherwise include, memory controller hubs, input/output control hubs, firmware devices, communication links (i.e., point-to-point links, bus links, wires, cables, light guides, printed circuit board traces, etc.) and/or other components and subsystems to facilitate the input/output operations.

The computing device 800 may include other or additional components, such as those commonly found in a typical computing device (e.g., various input/output devices and/or other components), in other embodiments. It should be further appreciated that one or more of the components of the computing device 800 described herein may be distributed across multiple computing devices. In other words, the techniques described herein may be employed by a computing system that includes one or more computing devices. Additionally, although only a single processing device 802, I/O device 804, and memory 806 are illustratively shown in FIG. 25, it should be appreciated that a particular computing device 800 may include multiple processing devices 802, I/O devices 804, and/or memories 806 in other embodiments. Further, in some embodiments, more than one external device 810 may be in communication with the computing device 800.

Figure 26:
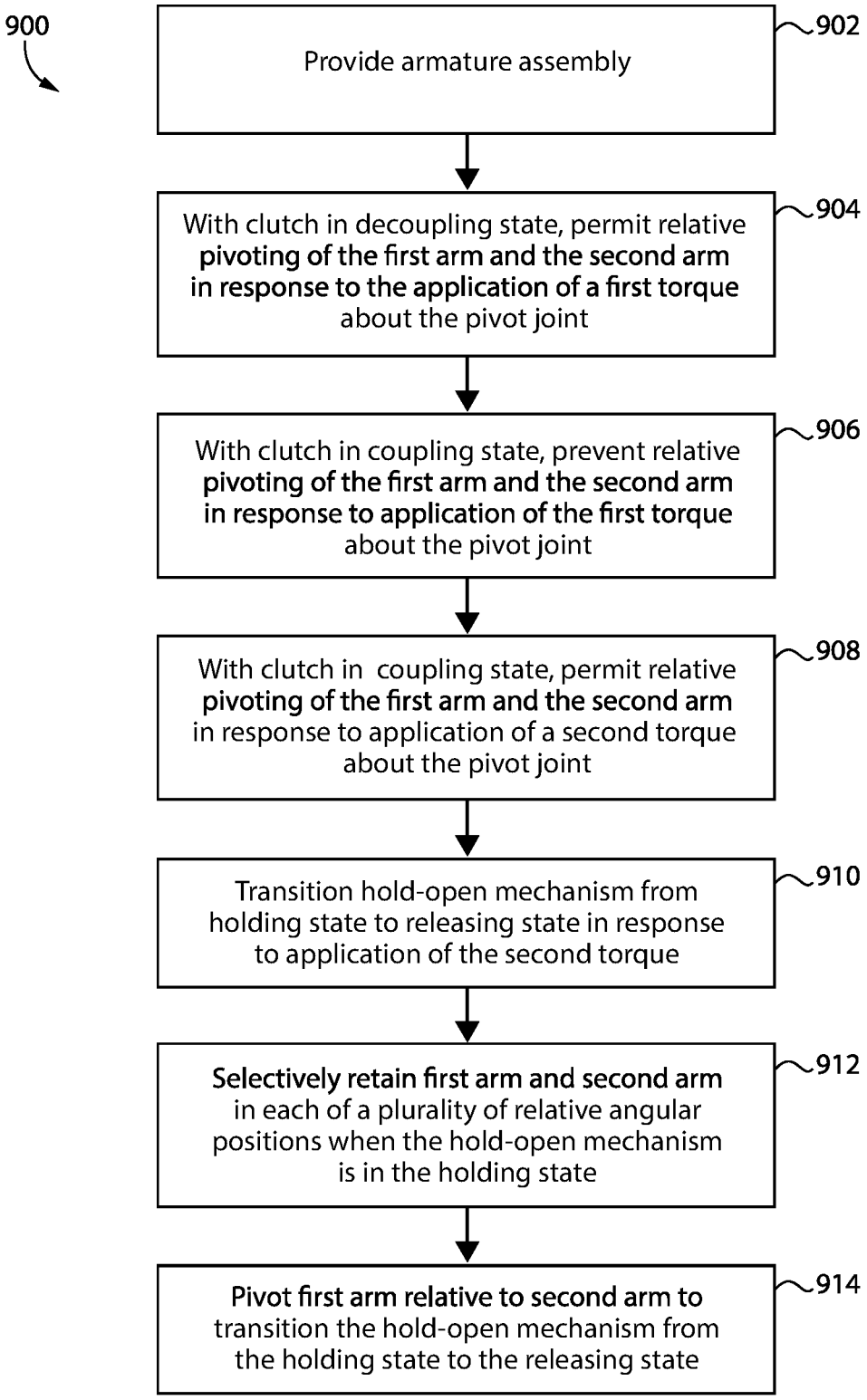
FIG. 26 is a schematic flow diagram of a process according to certain embodiments.

With additional reference to FIG. 26, illustrated therein is a process 900 of operating an armature assembly with a door closer including a pinion. The process 900 includes block 902, which generally involves providing the armature assembly with a first arm configured for rotational coupling with the pinion and a second arm pivotably coupled to the first arm at a pivot joint. The armature assembly further includes a hold-open mechanism having a releasing state and a holding state, the hold-open mechanism including a clutch operable to selectively prevent relative pivoting of the first arm and the second arm, the clutch having a decoupling state corresponding to the releasing state and a coupling state corresponding to the holding state. The process 900 includes block 904, which is performed when the clutch is in the decoupling state, and which generally involves permitting relative pivoting of the first arm and the second arm in response to the application of a first torque about the pivot joint. The process 900 includes block 906, which is performed when the clutch is in the coupling state, and which generally involves preventing the relative pivoting of the first arm and the second arm in response to application of the first torque about the pivot joint. The process 900 includes block 908, which is performed when the clutch is in the coupling state, and which generally involves permitting the relative pivoting of the first arm and the second arm in response to application of a second torque about the pivot joint, wherein the second torque is greater than the first torque. In certain embodiments, the process 900 includes block 910, which generally involves transitioning the hold-open mechanism from the holding state to the releasing state in response to application of the second torque. In certain embodiments, the process 900 includes block 912, which generally involves selectively retaining the first arm and the second arm in each of a plurality of relative angular positions when the hold-open mechanism is in the holding state. In certain embodiments, the process 900 includes block 914, which generally involves pivoting the first arm relative to the second arm to transition the hold-open mechanism from the holding state to the releasing state.

While the invention has been illustrated and described in detail in the drawings and foregoing description, the same is to be considered as illustrative and not restrictive in character, it being understood that only the preferred embodiments have been shown and described and that all changes and modifications that come within the spirit of the inventions are desired to be protected.

It should be understood that while the use of words such as preferabl5e, preferably, preferred or more preferred utilized in the description above indicate that the feature so described may be more desirable, it nonetheless may not be necessary and embodiments lacking the same may be contemplated as within the scope of the invention, the scope being defined by the claims that follow. In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary.

What is claimed is:

1. An armature assembly for a door closer comprising a pinion, the armature assembly comprising:

a first arm configured for rotational coupling with the pinion;

a second arm pivotably coupled to the first arm at a pivot joint; and a hold-open mechanism having a releasing state and a holding state, the hold-open mechanism comprising:

a clutch operable to selectively prevent relative pivoting of the first arm and the second arm, the clutch having a decoupling state corresponding to the releasing state and a coupling state corresponding to the holding state; and an electromechanical driver operable to transition the clutch between the coupling state and the decoupling state;

wherein the clutch in the decoupling state permits the relative pivoting of the first arm and the second arm in response to application of a first torque about the pivot joint;

wherein the clutch in the coupling state prevents the relative pivoting of the first arm and the second arm in response to application of the first torque about the pivot joint; and wherein the clutch in the coupling state permits the relative pivoting of the first arm and the second arm in response to application of a second torque about the pivot joint, wherein the second torque is greater than the first torque.

2. The armature assembly of claim 1, wherein the clutch comprises:

a transmission component rotationally coupled with the first arm; and an engagement member mounted to the second arm, the engagement member having an engaging position and a disengaging position, wherein the engagement member in the engaging position rotationally couples the transmission component with the second arm, and wherein the engagement member in the disengaging position rotationally decouples the transmission component from the second arm; and wherein the electromechanical driver is operable to move the engagement member between the engaging position and the disengaging position.

3. The armature assembly of claim 2, wherein the clutch further comprises a roller bearing having a coupling position in which the roller bearing rotationally couples the transmission component with the second arm and a decoupling position in which the transmission component is rotationally decoupled from the second arm;

wherein the engagement member in the engaging position maintains the roller bearing in the coupling position; and wherein the engagement member in the disengaging position enables movement of the roller bearing between the coupling position and the decoupling position.

4. The armature assembly of claim 1, wherein the clutch comprises:

a gear operable to rotationally couple with the first arm;

a movable component mounted to the second arm, the movable component comprising a nose engaged with the gear such that rotation of the gear with the first arm urges the movable component in a rearward direction; and a biasing member urging the movable component in a forward direction opposite the rearward direction.

5. The armature assembly of claim 4, wherein the biasing member comprises an override spring;

wherein the override spring prevents rearward movement of the movable component when the first torque is applied, thereby preventing relative pivoting of the first arm and the second arm; and wherein the override spring permits rearward movement of the movable component when the second torque is applied, thereby permitting relative pivoting of the first arm and the second arm.

6. The armature assembly of claim 4, wherein the clutch further comprises a housing and an engagement member;

wherein the housing is movable relative to the second arm in the forward direction and the rearward direction;

wherein the engagement member has an engaging position in which the engagement member couples the movable component and the housing for joint movement in the rearward direction;

wherein the engagement member has a disengaging position in which the movable component is operable to move in the rearward direction relative to the housing;

wherein the biasing member is engaged between the housing and the movable component and biases the movable component in the forward direction relative to the housing; and wherein the hold-open mechanism further comprises an override biasing member urging the housing in the forward direction.

7. The armature assembly of claim 6, wherein a first force generated by the biasing member is less than a second force generated by the override biasing member.

8. The armature assembly of claim 6, wherein the electromechanical driver is operable to move the engagement member between the engaging position and the disengaging position.

9. The armature assembly of claim 1, wherein the hold-open mechanism is configured to transition from the holding state to the releasing state in response to application of the second torque.

10. The armature assembly of claim 9, wherein the electromechanical driver is configured to transition the clutch from the coupling state to the decoupling state in response to relative pivoting of the first arm and the second arm.

11. The armature assembly of claim 1, wherein the hold-open mechanism in the holding state is configured to selectively retain the first arm and the second arm in each of a plurality of relative angular positions.

12. The armature assembly of claim 1, wherein the hold-open mechanism is configured to transition from the holding state to the releasing state in response to relative pivoting of the first arm and the second arm.

13. A door closer assembly comprising the armature assembly of claim 1 and the door closer, the door closer further comprising a closer body exerting on the pinion closing forces urging the pinion to rotate in a closing direction;

wherein the first arm is rotationally coupled with the pinion; and wherein the second arm is pivotably coupled with a shoe.

14. The door closer assembly of claim 13, wherein the closing forces urging the pinion to rotate in the closing direction generate the first torque when the second arm is held in a fixed position.

15. The door closer assembly of claim 13, further comprising a sensor module, the sensor module comprising:

a housing mounted to the closer body;

a Hall effect sensor mounted within the housing;

a cap rotationally coupled with the pinion; and a magnet mounted to the cap such that the Hall effect sensor generates information relating to a rotational position of the pinion.

16. The door closer assembly of claim 15, further comprising a controller in communication with the Hall effect sensor and the electromechanical driver; and wherein the controller is configured to control operation of the electromechanical driver based at least in part upon the information relating to the rotational position of the pinion.

17. A method of operating the armature assembly of claim 1 in association with the door closer and a door, wherein the method comprises:

with the hold-open mechanism in the holding state and the clutch in the coupling state, generating a resistive torque that prevents the relative pivoting of the first arm and the second arm, thereby retaining the door in an open position against the first torque; and with the hold-open mechanism in the holding state and the clutch in the coupling state and in response to a release condition, transitioning the hold-open mechanism to the releasing state and the clutch to the decoupling state, thereby reducing the resistive torque and permitting the door to move from the open position to a closed position.

18. The method of claim 17, wherein the release condition comprises movement of the door from the open position to the closed position in response to application of the second torque.

19. The method of claim 18, wherein the first torque is applied to the door by the door closer, and wherein the second torque is manually applied to the door by a user.

20. The method of claim 17, further comprising sensing a rotational position of the pinion, and wherein operating the electromechanical driver transitions the hold-open mechanism from the releasing state to the holding state and is performed based upon information related to the rotational position of the pinion.

21. The method of claim 17, wherein transitioning the hold-open mechanism to the releasing state comprises operating the electromechanical driver to transition the hold-open mechanism from the holding state to the releasing state.

22. The method of claim 21, wherein the release condition comprises receiving a release signal from a location remote from the door closer.

23. The method of claim 21, further comprising sensing a rotational position of the pinion, wherein the release condition relates to the rotational position of the pinion.

24. The method of claim 23, further comprising mounting a sensor module to the door closer;

wherein mounting the sensor module to the door closer comprises:

mounting a housing of the sensor module to a closer body of the door closer, wherein the housing has disposed therein a Hall effect sensor; and mounting a cap to the pinion, wherein a magnet is mounted to the cap; and wherein sensing the rotational position of the pinion comprises sensing the rotational position of the pinion based upon information received from the Hall effect sensor.

25. The armature assembly of claim 1, wherein the electromechanical driver is mounted to one of the first arm or the second arm.

26. The armature assembly of claim 1, wherein the clutch is mounted to at least one of the first arm or the second arm.

27. The armature assembly of claim 1, wherein a portion of the clutch is mounted for rotation about the pivot joint.

28. A method of operating an armature assembly with a door closer including a pinion, the method comprising:

providing the armature assembly with a first arm configured for rotational coupling with the pinion and a second arm pivotably coupled to the first arm at a pivot joint, the armature assembly including a hold-open mechanism having a releasing state and a holding state, the hold-open mechanism including a clutch operable to selectively prevent relative pivoting of the first arm and the second arm, the clutch having a decoupling state corresponding to the releasing state and a coupling state corresponding to the holding state;

with the clutch in the decoupling state, permitting relative pivoting of the first arm and the second arm in response to the application of a first torque about the pivot joint;

with the clutch in the coupling state, preventing the relative pivoting of the first arm and the second arm in response to application of the first torque about the pivot joint; and with the clutch in the coupling state, permitting the relative pivoting of the first arm and the second arm in response to application of a second torque about the pivot joint, wherein the second torque is greater than the first torque.

29. The method of claim 28, further comprising transitioning the hold-open mechanism from the holding state to the releasing state in response to application of the second torque.

30. The method of claim 28, further comprising selectively retaining the first arm and the second arm in each of a plurality of relative angular positions when the hold-open mechanism is in the holding state.

31. The method of claim 28, further comprising pivoting the first arm relative to the second arm to transition the hold-open mechanism from the holding state to the releasing state.

* * * * *